US012000678B2

(12) United States Patent
Gish et al.

(10) Patent No.: US 12,000,678 B2
(45) Date of Patent: Jun. 4, 2024

(54) MECHANISMS FOR MAGAZINE LOCK AND RELEASE

(71) Applicant: Axon Enterprise, Inc., Scottsdale, AZ (US)

(72) Inventors: Michael E. Gish, Scottsdale, AZ (US); Patrick W. Smith, Scottsdale, AZ (US); John Groff, San Francisco, CA (US); Mark Eastwood, Scottsdale, AZ (US); Alex Kensil, Oakland, CA (US); Arturo Meuniot, San Francisco, CA (US); Trevor Ryan, Tahoe City, CA (US); Michael Roberts, San Francisco, CA (US)

(73) Assignee: Axon Enterprise, Inc., Scottsdale, AZ (US)

( * ) Notice: Subject to any disclaimer, the term of this patent is extended or adjusted under 35 U.S.C. 154(b) by 0 days.

(21) Appl. No.: 17/871,728

(22) Filed: Jul. 22, 2022

(65) Prior Publication Data

US 2023/0021927 A1 Jan. 26, 2023

Related U.S. Application Data

(60) Provisional application No. 63/225,368, filed on Jul. 23, 2021.

(51) Int. Cl.
*F41H 13/00* (2006.01)
*F41A 17/38* (2006.01)

(52) U.S. Cl.
CPC ..... *F41H 13/0025* (2013.01); *F41A 17/38* (2013.01)

(58) Field of Classification Search
CPC ..... F41H 13/0025
(Continued)

(56) References Cited

U.S. PATENT DOCUMENTS 10,168,127 B1 1/2019 Salisbury et al.
2006/0120009 A1 6/2006 Chudy
(Continued)

FOREIGN PATENT DOCUMENTS

TW M613468 U 6/2021
WO WO-2012128670 A2 * 9/2012 ..... F41H 13/0025
WO 2020-197439 A1 10/2020

OTHER PUBLICATIONS

Korean Intellectual Property Office, International Search Report and Written Opinion for International Application No. PCT/US2022/038062 dated Nov. 3, 2022.
(Continued)

*Primary Examiner* — Reginald S Tillman, Jr.
(74) *Attorney, Agent, or Firm* — H S. Malvich, Jr.; Andrew Graham

(57) ABSTRACT

A conducted electrical weapon ("CEW") comprises one or more mechanisms for receiving, aligning, and maintaining a position of a magazine within a bay of the CEW. Bias spring and datums may be used to align the magazine to be coupled to the CEW, wherein bias springs are configured to apply pressure to push the magazine to interact with datums to align the magazine. A spring and ramp mechanism may be used to maintain a position of the magazine coupled to the bay of the CEW. Respective grades of a locking ramp and a release ramp are used to lock a spring in place when a magazine is coupled to the bay of the CEW.

20 Claims, 13 Drawing Sheets

(58) Field of Classification Search
USPC ..... 361/232
See application file for complete search history.

(56) References Cited

U.S. PATENT DOCUMENTS

| | | | |
|---|---|---|---|
| 2006/0207466 | A1 | 9/2006 | McNulty et al. |
| 2016/0010956 | A1 | 1/2016 | Hanchett |
| 2020/0096297 | A1 | 3/2020 | Norris |

OTHER PUBLICATIONS

Taiwan Intellectual Property Office, Office Action for Taiwan Application No. 111138457 mailed Dec. 18, 2023.

* cited by examiner

MECHANISMS FOR MAGAZINE LOCK AND RELEASE

CROSS-REFERENCE TO RELATED APPLICATIONS

This application claims the benefit of U.S. Provisional Application 63/225,368, filed Jul. 23, 2021, which is incorporated by reference herein in its entirety.

FIELD OF THE INVENTION

Embodiments of the present invention relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
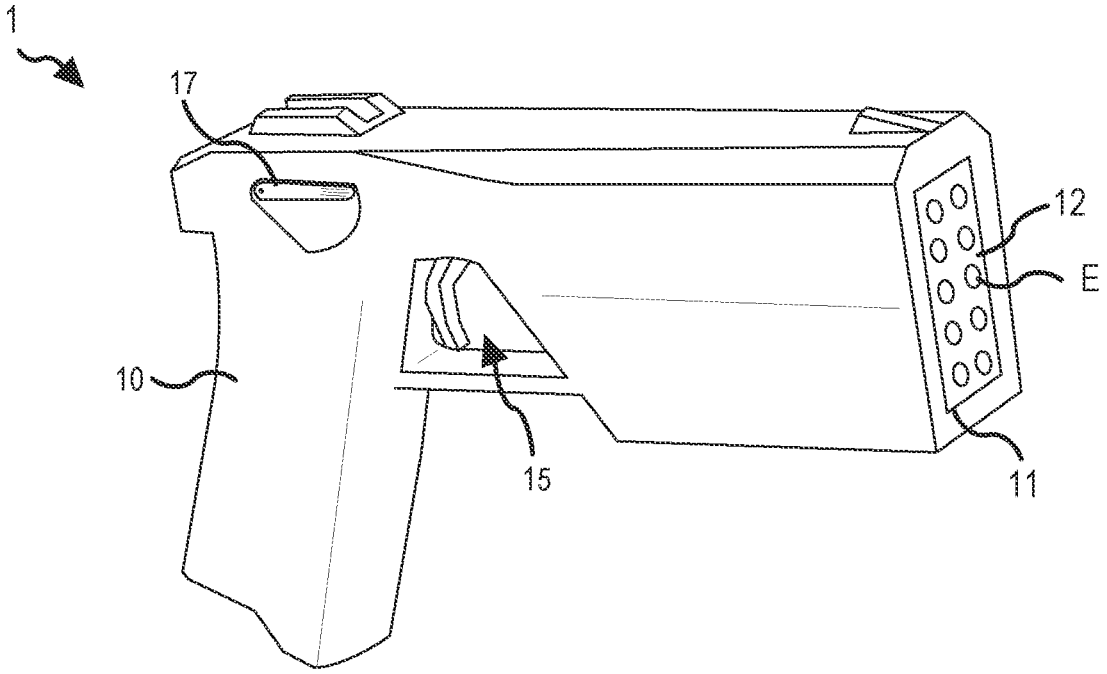
FIG. 1 is a perspective view of a conducted electrical weapon ("CEW"), in accordance with various embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, and/or any other similar device or apparatus configured to provide a stimulus signal through one or more deployed projectiles (e.g., electrodes).

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a magazine (e.g., deployment unit). The terminals are spaced apart from each other. In response to the electrodes of the magazine in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more magazines. The handle may include one or more bays for receiving the magazine(s). Each magazine may be removably positioned in (e.g., inserted into, coupled to, etc.) a bay. Each magazine may releasably electrically, electronically, and/or mechanically couple to a bay. A deployment of the CEW may launch one or more electrodes from the magazine and toward a target to remotely deliver the stimulus signal through the target.

In various embodiments, a magazine may receive one or more cartridges (e.g., deployment units, etc.). The magazine may comprise a respective bore in which each cartridge of the one or more cartridges may be received. The magazine may receive a cartridge of the cartridge(s) prior to and during use of the cartridge to provide a stimulus signal. The magazine may align the cartridge(s) with a housing of a CEW handle to enable respective use of each cartridge of the cartridge(s).

In various embodiments, a cartridge may include one or more electrodes that are launched at a same time. In various embodiments, a magazine may include two or more cartridges comprising respective electrode(s) that may each be launched individually at separate times. In various embodiments, a cartridge may include a single electrode configured to be launched from the magazine. Launching the electrodes may be referred to as activating (e.g., firing) a cartridge or electrode. After use (e.g., activation, firing), a cartridge may be removed from the bay and replaced with an unused (e.g., not fired, not activated) cartridge to permit launch of additional electrodes.

Figure 2:
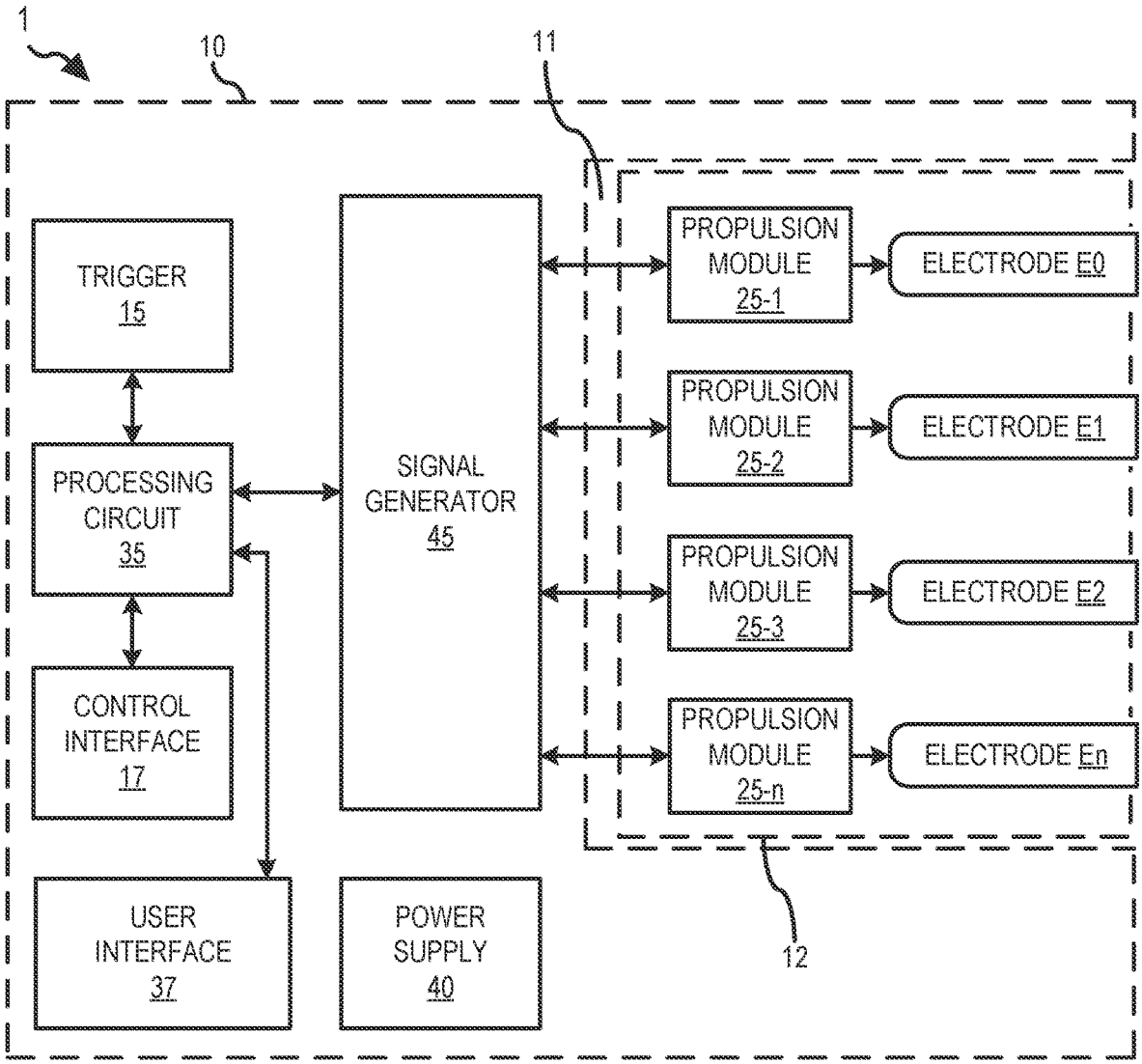
FIG. 2 is a schematic view of a CEW, in accordance with various embodiments.

In various embodiments, and with reference to FIGS. 1 and 2, a CEW 1 is disclosed. CEW 1 may be similar to, or have similar aspects and/or components with, any CEW discussed herein. CEW 1 may comprise a CEW handle 10 and a magazine 12. It should be understood by one skilled in the art that FIG. 2 is a schematic representation of CEW 1, and one or more of the components of CEW 1 may be located in any suitable position within, or external to, CEW handle 10.

CEW handle 10 may comprise a housing. The housing may be configured to house various components of CEW 1 that are configured to enable deployment of magazine 12, provide an electrical current to magazine 12, and otherwise aid in the operation of CEW 1, as discussed further herein. Although depicted as a firearm in FIG. 1, the housing of CEW handle 10 may comprise any suitable shape and/or size. The housing of CEW handle 10 may comprise a handle end opposite a deployment end. A deployment end may be configured, and sized and shaped, to receive one or more magazine 12. A handle end may be sized and shaped to be held in a hand of a user. For example, a handle end may be shaped as a handle to enable hand-operation of CEW 1 by the user. In various embodiments, a handle end may also comprise contours shaped to fit the hand of a user, for example, an ergonomic grip. A handle end may include a surface coating, such as, for example, a non-slip surface, a grip pad, a rubber texture, and/or the like. As a further example, a handle end may be wrapped in leather, a colored print, and/or any other suitable material, as desired.

In various embodiments, CEW handle 10 may comprise various mechanical, electronic, and/or electrical components configured to aid in performing the functions of CEW 1. For example, CEW handle 10 may comprise one or more triggers 15, control interfaces 17, processing circuits 35, power supplies 40, and/or signal generators 45. CEW handle 10 may include a guard (e.g., trigger guard). A guard may define an opening formed in a housing of CEW handle 10. A guard may be located on a center region of the housing of CEW handle 10 (e.g., as depicted in FIG. 1), and/or in any other suitable location on the housing of CEW handle 10. Trigger 15 may be disposed within a guard. A guard may be configured to protect trigger 15 from unintentional physical contact (e.g., an unintentional activation of trigger 15). A guard may surround trigger 15 within the housing of CEW handle 10.

In various embodiments, trigger 15 be coupled to an outer surface of CEW handle 10, and may be configured to move, slide, rotate, or otherwise become physically depressed or moved upon application of physical contact. For example, trigger 15 may be actuated by physical contact applied to trigger 15 from within a guard. Trigger 15 may comprise a mechanical or electromechanical switch, button, trigger, or the like. For example, trigger 15 may comprise a switch, a pushbutton, and/or any other suitable type of trigger. Trigger 15 may be mechanically and/or electronically coupled to processing circuit 35. In response to trigger 15 being activated (e.g., depressed, pushed, etc. by the user), processing circuit 35 may enable deployment of (or cause deployment of) one or more magazine 12 from CEW 1, as discussed further herein.

In various embodiments, power supply 40 may be configured to provide power to various components of CEW 1. For example, power supply 40 may provide energy for operating the electronic and/or electrical components (e.g., parts, subsystems, circuits, etc.) of CEW 1 and/or one or more magazine 12. Power supply 40 may provide electrical power. Providing electrical power may include providing a current at a voltage. Power supply 40 may be electrically coupled to processing circuit 35 and/or signal generator 45. In various embodiments, in response to a control interface comprising electronic properties and/or components, power supply 40 may be electrically coupled to the control interface. In various embodiments, in response to trigger 15 comprising electronic properties or components, power supply 40 may be electrically coupled to trigger 15. Power supply 40 may provide an electrical current at a voltage. Electrical power from power supply 40 may be provided as a direct current ("DC"). Electrical power from power supply 40 may be provided as an alternating current ("AC"). Power supply 40 may include a battery. The energy of power supply 40 may be renewable or exhaustible, and/or replaceable. For example, power supply 40 may comprise one or more rechargeable or disposable batteries. In various embodiments, the energy from power supply 40 may be converted from one form (e.g., electrical, magnetic, thermal) to another form to perform the functions of a system.

Power supply 40 may provide energy for performing the functions of CEW 1. For example, power supply 40 may provide the electrical current to signal generator 45 that is provided through a target to impede locomotion of the target (e.g., via magazine 12). Power supply 40 may provide the energy for a stimulus signal. Power supply 40 may provide the energy for other signals, including an ignition signal, as discussed further herein.

In various embodiments, processing circuit 35 may comprise any circuitry, electrical components, electronic components, software, and/or the like configured to perform various operations and functions discussed herein. For example, processing circuit 35 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 35 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 35 may include data buses, output ports, input ports, timers, memory, arithmetic units, and/or the like.

In various embodiments, processing circuit 35 may include signal conditioning circuity. Signal conditioning circuitry may include level shifters to change (e.g., increase, decrease) the magnitude of a voltage (e.g., of a signal) before receipt by processing circuit 35 or to shift the magnitude of a voltage provided by processing circuit 35.

In various embodiments, processing circuit 35 may be configured to control and/or coordinate operation of some or all aspects of CEW 1. For example, processing circuit 35 may include (or be in communication with) memory configured to store data, programs, and/or instructions. The memory may comprise a tangible non-transitory computer-readable memory. Instructions stored on the tangible non-transitory memory may allow processing circuit 35 to perform various operations, functions, and/or steps, as described herein.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Processing circuit 35 may be configured to provide and/or receive electrical signals whether digital and/or analog in form. Processing circuit 35 may provide and/or receive digital information via a data bus using any protocol. Processing circuit 35 may receive information, manipulate the received information, and provide the manipulated information. Processing circuit 35 may store information and retrieve stored information. Information received, stored, and/or manipulated by processing circuit 35 may be used to perform a function, control a function, and/or to perform an operation or execute a stored program.

Processing circuit 35 may control the operation and/or function of other circuits and/or components of CEW 1. Processing circuit 35 may receive status information regarding the operation of other components, perform calculations with respect to the status information, and provide commands (e.g., instructions) to one or more other components. Processing circuit 35 may command another component to start operation, continue operation, alter operation, suspend operation, cease operation, or the like. Commands and/or status may be communicated between processing circuit 35 and other circuits and/or components via any type of bus (e.g., SPI bus) including any type of data/address bus.

In various embodiments, processing circuit 35 may be mechanically and/or electronically coupled to trigger 15. Processing circuit 35 may be configured to detect an activation, actuation, depression, input, etc. (collectively, an "activation event") of trigger 15. In response to detecting the activation event, processing circuit 35 may be configured to perform various operations and/or functions, as discussed further herein. Processing circuit 35 may also include a sensor (e.g., a trigger sensor) attached to trigger 15 and configured to detect an activation event of trigger 15. The sensor may comprise any suitable sensor, such as a mechanical and/or electronic sensor capable of detecting an activation event in trigger 15 and reporting the activation event to processing circuit 35.

In various embodiments, processing circuit 35 may be mechanically and/or electronically coupled to control interface 17. Processing circuit 35 may be configured to detect an activation, actuation, depression, input, etc. (collectively, a "control event") of control interface 17. In response to detecting the control event, processing circuit 35 may be configured to perform various operations and/or functions, as discussed further herein. Processing circuit 35 may also include a sensor (e.g., a control sensor) attached to control interface 17 and configured to detect a control event of control interface 17. The sensor may comprise any suitable mechanical and/or electronic sensor capable of detecting a control event in control interface 17 and reporting the control event to processing circuit 35.

In various embodiments, processing circuit 35 may be electrically and/or electronically coupled to power supply 40. Processing circuit 35 may receive power from power supply 40. The power received from power supply 40 may be used by processing circuit 35 to receive signals, process signals, and transmit signals to various other components in CEW 1. Processing circuit 35 may use power from power supply 40 to detect an activation event of trigger 15, a control event of control interface 17, or the like, and generate one or more control signals in response to the detected events. The control signal may be based on the control event and the activation event. The control signal may be an electrical signal.

In various embodiments, processing circuit 35 may be electrically and/or electronically coupled to signal generator 45. Processing circuit 35 may be configured to transmit or provide control signals to signal generator 45 in response to detecting an activation event of trigger 15. Multiple control signals may be provided from processing circuit 35 to signal generator 45 in series. In response to receiving the control signal, signal generator 45 may be configured to perform various functions and/or operations, as discussed further herein.

In various embodiments, signal generator 45 may be configured to receive one or more control signals from processing circuit 35. Signal generator 45 may provide an ignition signal to magazine 12 based on the control signals. Signal generator 45 may be electrically and/or electronically coupled to processing circuit 35 and/or magazine 12. Signal generator 45 may be electrically coupled to power supply 40. Signal generator 45 may use power received from power supply 40 to generate an ignition signal. For example, signal generator 45 may receive an electrical signal from power supply 40 that has first current and voltage values. Signal generator 45 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 45 may temporarily store power from power supply 40 and rely on the stored power entirely or in part to provide the ignition signal. Signal generator 45 may also rely on received power from power supply 40 entirely or in part to provide the ignition signal, without needing to temporarily store power.

Signal generator 45 may be controlled entirely or in part by processing circuit 35. In various embodiments, signal generator 45 and processing circuit 35 may be separate components (e.g., physically distinct and/or logically discrete). Signal generator 45 and processing circuit 35 may be a single component. For example, a control circuit within CEW handle 10 may at least include signal generator 45 and processing circuit 35. The control circuit may also include other components and/or arrangements, including those that further integrate corresponding function of these elements into a single component or circuit, as well as those that further separate certain functions into separate components or circuits.

Signal generator 45 may be controlled by the control signals to generate an ignition signal having a predetermined current value or values. For example, signal generator 45 may include a current source. The control signal may be received by signal generator 45 to activate the current source at a current value of the current source. An additional control signal may be received to decrease a current of the current source. For example, signal generator 45 may include a pulse width modification circuit coupled between a current source and an output of the control circuit. A second control signal may be received by signal generator 45 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 45 may alternatively or additionally be employed, including those that apply a voltage over one or more different resistances to generate signals with different currents. In various embodiments, signal generator 45 may include a high-voltage module configured to deliver an electrical current having a high voltage. In various embodiments, signal generator 45 may include a low-voltage module configured to deliver an electrical current having a lower voltage, such as, for example, 2,000 volts.

Responsive to receipt of a signal indicating activation of trigger 15 (e.g., an activation event), a control circuit provides an ignition signal to magazine 12 (or an electrode in magazine 12). For example, signal generator 45 may provide an electrical signal as an ignition signal to magazine 12 in response to receiving a control signal from processing circuit 35. In various embodiments, the ignition signal may be separate and distinct from a stimulus signal. For example, a stimulus signal in CEW 1 may be provided to a different circuit within magazine 12, relative to a circuit to which an ignition signal is provided. Signal generator 45 may be configured to generate a stimulus signal. In various embodiments, a second, separate signal generator, component, or circuit (not shown) within CEW handle 10 may be configured to generate the stimulus signal. Signal generator 45 may also provide a ground signal path for magazine 12, thereby completing a circuit for an electrical signal provided to magazine 12 by signal generator 45. The ground signal path may also be provided to magazine 12 by other elements in CEW handle 10, including power supply 40.

In various embodiments, a bay 11 of CEW handle 10 may be configured (to receive one or more magazine 12. Bay 11 may comprise an opening in an end of CEW handle 10 sized and shaped to receive one or more magazine 12. Bay 11 may include one or more mechanical features configured to removably couple one or more magazine 12 within bay 11. Bay 11 of CEW handle 10 may be configured to receive a single magazine, two magazines, three magazines, nine magazines, or any other number of magazines.

Magazine 12 may receive one or more cartridges comprising one or more propulsion modules 25 and one or more electrodes E. For example, a cartridge received by magazine 12 may comprise a single propulsion module 25 configured to deploy a single electrode E. As a further example, a cartridge received by magazine 12 may comprise a single propulsion module 25 configured to deploy a plurality of electrodes E. As a further example, a magazine 12 may comprise a plurality of propulsion modules 25 and a plurality of electrodes E, with each propulsion module 25 configured to deploy one or more electrodes E. In various embodiments, and as depicted in FIG. 2, magazine 12 may comprise a first propulsion module 25-1 configured to deploy a first electrode E0, a second propulsion module 25-2 configured to deploy a second electrode E1, a third propulsion module 25-3 configured to deploy a third electrode E2, and a fourth propulsion module 25-4 configured to deploy a fourth electrode E3. Each series of propulsion modules and electrodes may be contained in the same and/or separate cartridges.

In various embodiments, a propulsion module 25 may be coupled to, or in communication with one or more electrodes E in magazine 12. In various embodiments, magazine 12 may comprise a plurality of propulsion modules 25, with each propulsion module 25 coupled to, or in communication with, one or more electrodes E. A propulsion module 25 may comprise any device, propellant (e.g., air, gas, etc.), primer, or the like capable of providing a propulsion force in magazine 12. The propulsion force may include an increase in pressure caused by rapidly expanding gas within an area or chamber. The propulsion force may be applied to one or more electrodes E in magazine 12 to cause the deployment of the one or more electrodes E. A propulsion module 25 may provide the propulsion force in response to magazine 12 receiving an ignition signal, as previously discussed.

In various embodiments, the propulsion force may be directly applied to one or more electrodes E. For example, a propulsion force from propulsion module 25-1 may be provided directly to first electrode E0. A propulsion module 25 may be in fluid communication with one or more electrodes E to provide the propulsion force. For example, a propulsion force from propulsion module 25-1 may travel within a housing or channel of magazine 12 to first electrode E0. The propulsion force may travel via a manifold in magazine 12.

In various embodiments, the propulsion force may be provided indirectly to one or more electrodes E. For example, the propulsion force may be provided to a secondary source of propellant within propulsion system 125. The propulsion force may launch the secondary source of propellant within propulsion system 125, causing the secondary source of propellant to release propellant. A force associated with the released propellant may in turn provide a force to one or more electrodes E. A force generated by a secondary source of propellant may cause the one or more electrodes E to be deployed from the magazine 12 and CEW 1.

In various embodiments, each electrode E0, E1, E2, E3 may each comprise any suitable type of projectile. For example, one or more electrodes E may be or include a projectile, an electrode (e.g., an electrode dart), an entablement projectile, a payload projectile (e.g., comprising a liquid or gas substance), or the like. An electrode may include a spear portion, designed to pierce or attach proximate a tissue of a target in order to provide a conductive electrical path between the electrode and the tissue, as previously discussed herein.

Control interface 17 of CEW 1 may comprise, or be similar to, any control interface disclosed herein. In various embodiments, control interface 17 may be configured to control selection of firing modes in CEW 1. Controlling selection of firing modes in CEW 1 may include disabling firing of CEW 1 (e.g., a safety mode, etc.), enabling firing of CEW 1 (e.g., an active mode, a firing mode, an escalation mode, etc.), controlling deployment of magazine 12, and/or similar operations, as discussed further herein. In various embodiments, control interface 17 may also be configured to perform (or cause performance of) one or more operations that do not include the selection of firing modes. For example, control interface 17 may be configured to enable the selection of operating modes of CEW 1, selection of options within an operating mode of CEW 1, or similar selection or scrolling operations, as discussed further herein.

Control interface 17 may be located in any suitable location on or in CEW handle 10. For example, control interface 17 may be coupled to an outer surface of CEW handle 10. Control interface 17 may be coupled to an outer surface of CEW handle 10 proximate trigger 15 and/or a guard of CEW handle 10. Control interface 17 may be electrically, mechanically, and/or electronically coupled to processing circuit 35. In various embodiments, in response to control interface 17 comprising electronic properties or components, control interface 17 may be electrically coupled to power supply 40. Control interface 17 may receive power (e.g., electrical current) from power supply 40 to power the electronic properties or components.

Control interface 17 may be electronically or mechanically coupled to trigger 15. For example, and as discussed further herein, control interface 17 may function as a safety mechanism. In response to control interface 17 being set to a "safety mode," CEW 1 may be unable to launch electrodes from magazine 12. For example, control interface 17 may provide a signal (e.g., a control signal) to processing circuit 35 instructing processing circuit 35 to disable deployment of electrodes from magazine 12. As a further example, control interface 17 may electronically or mechanically prohibit trigger 15 from activating (e.g., prevent or disable a user from depressing trigger 15; prevent trigger 15 from launching an electrode; etc.).

Control interface 17 may comprise any suitable electronic or mechanical component capable of enabling selection of firing modes. For example, control interface 17 may comprise a fire mode selector switch, a safety switch, a safety catch, a rotating switch, a selection switch, a selective firing mechanism, and/or any other suitable mechanical control. As a further example, control interface 17 may comprise a slide, such as a handgun slide, a reciprocating slide, or the like. As a further example, control interface 17 may comprise a touch screen, user interface or display, or similar electronic visual component.

The safety mode may be configured to prohibit deployment of an electrode from magazine 12 in CEW 1. For example, in response to a user selecting the safety mode, control interface 17 may transmit a safety mode instruction to processing circuit 35. In response to receiving the safety mode instruction, processing circuit 35 may prohibit deployment of an electrode from magazine 12. Processing circuit 35 may prohibit deployment until a further instruction is received from control interface 17 (e.g., a firing mode instruction). As previously discussed, control interface 17 may also, or alternatively, interact with trigger 15 to prevent activation of trigger 15. In various embodiments, the safety mode may also be configured to prohibit deployment of a stimulus signal from signal generator 45, such as, for example, a local delivery.

The firing mode may be configured to enable deployment of one or more electrodes from magazine 12 in CEW 1. For example, and in accordance with various embodiments, in response to a user selecting the firing mode, control interface 17 may transmit a firing mode instruction to processing circuit 35. In response to receiving the firing mode instruction, processing circuit 35 may enable deployment of an electrode from magazine 12. In that regard, in response to trigger 15 being activated, processing circuit 35 may cause the deployment of one or more electrodes. Processing circuit 35 may enable deployment until a further instruction is received from control interface 17 (e.g., a safety mode instruction). As a further example, and in accordance with various embodiments, in response to a user selecting the firing mode, control interface 17 may also mechanically (or electronically) interact with trigger 15 of CEW 1 to enable activation of trigger 15.

In various embodiments, CEW 1 may deliver a stimulus signal via a circuit that includes signal generator 45 positioned in CEW handle 10 of CEW 1. An interface (e.g., cartridge interface, magazine interface, etc.) on each magazine 12 inserted into CEW handle 10 electrically couples to an interface (e.g., handle interface, housing interface, etc.) in CEW handle 10. Signal generator 45 couples to each magazine 12, and thus to the electrodes E, via the handle interface and the magazine interface. A first filament couples to the interface of the magazine 12 and to a first electrode. A second filament couples to the interface of the magazine 12 and to a second electrode. The stimulus signal travels from signal generator 45, through the first filament and the first electrode, through target tissue, and through the second electrode and second filament back to signal generator 45.

In various embodiments, CEW 1 may further comprise one or more user interfaces 37. A user interface 37 may be configured to receive an input from a user of CEW 1 and/or transmit an output to the user of CEW 1. User interface 37 may be located in any suitable location on or in a housing of CEW handle 10. For example, user interface 37 may be coupled to an outer surface of the housing of CEW handle 10, or extend at least partially through the outer surface of the housing of CEW handle 10. User interface 37 may be electrically, mechanically, and/or electronically coupled to processing circuit 35. In various embodiments, in response to user interface 37 comprising electronic or electrical properties or components, user interface 37 may be electrically coupled to power supply 40. User interface 37 may receive power (e.g., electrical current) from power supply 40 to power the electronic properties or components.

In various embodiments, user interface 37 may comprise one or more components configured to receive an input from a user. For example, user interface 37 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, user interface 37 may comprise one or more components configured to transmit or produce an output. For example, user interface 37 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

Figure 3A:
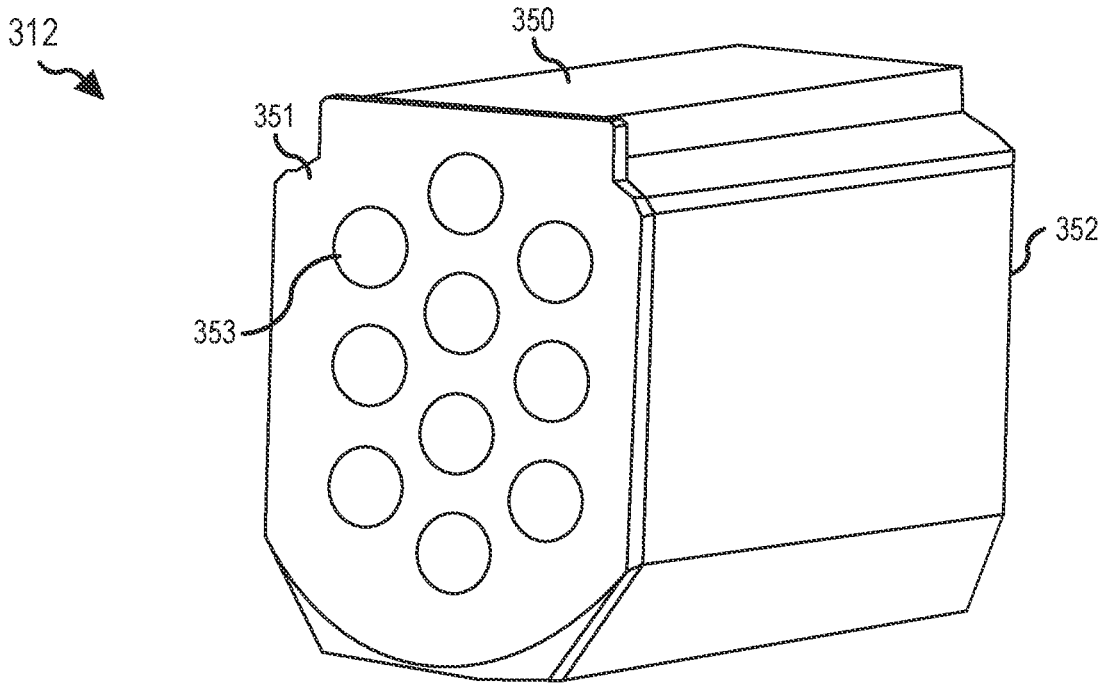
FIG. 3A is a front perspective view of a magazine for a CEW, in accordance with various embodiments.
Figure 3B:
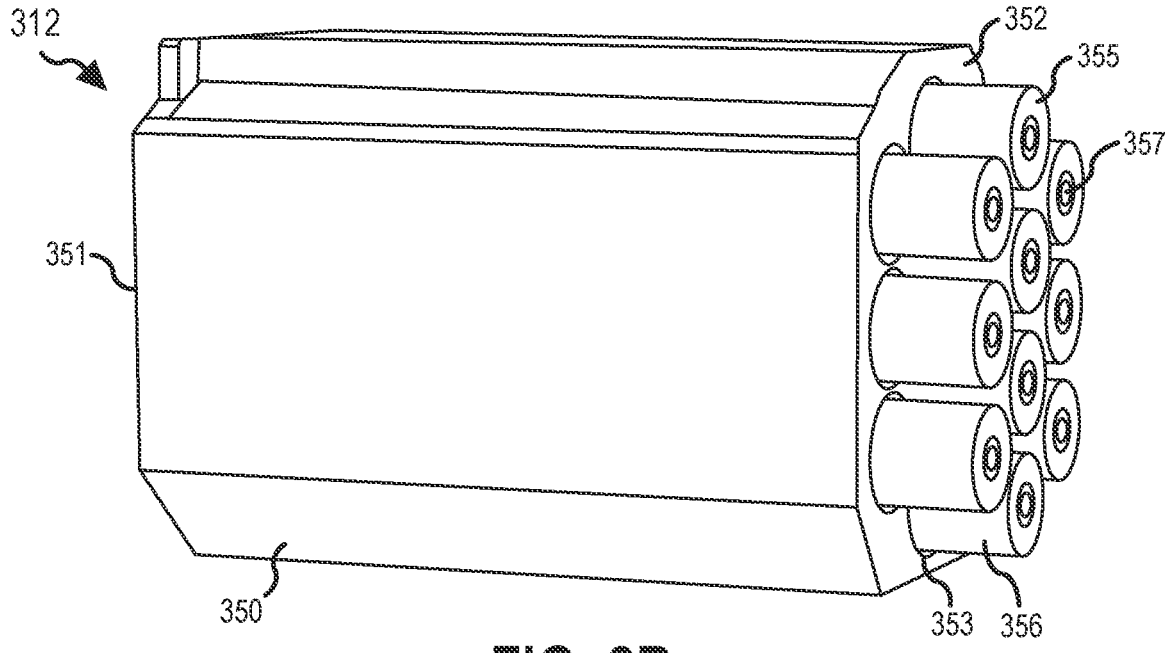
FIG. 3B is a rear perspective view of a magazine for a CEW, in accordance with various embodiments.

In various embodiments, and with reference to FIGS. 3A and 3B, a magazine 312 for a CEW is disclosed. Magazine 312 may be similar to any other magazine, deployment unit, or the like disclosed herein.

Magazine 312 may comprise a housing 350 sized and shaped to be inserted into the bay of a CEW handle, as previously discussed. Housing 350 may comprise a first end 351 (e.g., a deployment end, a front end, etc.) opposite a second end 352 (e.g., a loading end, a rear end, etc.). Magazine 312 may be configured to permit launch of one or more electrodes from first end 351 (e.g., electrodes are launched through first end 351). Magazine 312 may be configured to permit loading of one or more electrodes from second end 351. Second end 351 may also be configured to permit provision of stimulus signals from the CEW to the one or more electrodes. In some embodiments, magazine 312 may also be configured to permit loading of one or more electrodes from first end 351.

In various embodiments, housing 350 may define one or more bores 353. A bore 353 may comprise an axial opening through housing 350, defined and open on first end 351 and/or second end 352. Each bore 353 may be configured to receive an electrode (or cartridge containing an electrode). Each bore 353 may be sized and shaped accordingly to receive and house an electrode (or cartridge containing an electrode) prior to and during deployment of the electrode from magazine 312. Each bore 353 may comprise any suitable deployment angle. One or more bores 353 may comprise similar deployment angles. One or more bores 353 may comprise different deployment angles. Housing 350 may comprise any suitable or desired number of bores 353, such as, for example, two bores, five bores, nine bores, ten bores (e.g., as depicted), and/or the like.

In various embodiments, magazine 350 may be configured to receive one or more cartridges 355. A cartridge 355 may comprise a body 356 housing an electrode and one or more components necessary to deploy the electrode from body 356. For example, cartridge 355 may comprise an electrode and a propulsion module. The electrode may be similar to any other electrode, projectile, or the like disclosed herein. The propulsion module may be similar to any other propulsion module, primer, or the like disclosed herein.

In various embodiments, cartridge 355 may comprise a cylindrical outer body 356 defining a hollow inner portion. The hollow inner portion may house an electrode (e.g., an electrode, a spear, filament wire, etc.). The hollow inner portion may house a propulsion module configured to deploy the electrode from a first end of the cylindrical outer body 356. Cartridge 355 may include a piston positioned adjacent a second end of the electrode. Cartridge 355 may have the propulsion module positioned such that the piston is located between the electrode and the propulsion module.

Cartridge 355 may also have a wad positioned adjacent the piston, where the wad is located between the propulsion module and the piston.

In various embodiments, a cartridge 355 may comprise a contact 357 on an end of body 356. Contact 357 may be configured to allow cartridge 355 to receive an electrical signal from a CEW handle. For example, contact 357 may comprise an electrical contact configured to enable the completion of an electrical circuit between cartridge 355 and a signal generator of the CEW handle. In that regard, contact 357 may be configured to transmit (or provide) a stimulus signal from the CEW handle to the electrode. As a further example, contact 357 may be configured to transmit (or provide) an electrical signal (e.g., an ignition signal) from the CEW handle to a propulsion module within the cartridge 355. For example, contact 357 may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode from the cartridge 355.

In operation, a cartridge 355 may be inserted into a bore 353 of a magazine 312. The magazine 312 may be inserted into the bay of a CEW handle. The CEW may be operated to deploy an electrode from the cartridge 355 in magazine 312. Magazine 312 may be removed from the bay of the CEW handle. The cartridge 355 (e.g., a used cartridge, a spent cartridge, etc.) may be removed from the bore 353 of magazine 312. A new cartridge 355 may then be inserted into the same bore 353 of magazine 312 for additional deployments. The number of cartridges 355 that magazine 350 is capable of receiving may be dependent on a number of bores 353 in housing 350. For example, in response to housing 350 comprising ten bores 353, magazine 350 may be configured to receive at most ten cartridges 355 at the same time. As a further example, in response to housing 350 comprising two bores 353, magazine 350 may be configured to receive at most two cartridges 355 at the same time.

In embodiments, alignment between a magazine of a CEW and a handle of the CEW may impact a flight of projectile. Different alignments may cause different angles of deployment for the projection. Differences in alignment between when a first projectile is deployed and when a second projectile is deployed may change an impact location on a target for each of the projectiles, even when an orientation of the handle remains constant. The application of a propulsion force inside the magazine to deploy each projectile may apply a force between the magazine and handle, which may also provide a basis of separation or other relative movement between the magazine and handle. Embodiments according to various aspects of the present disclosure address these and other technical problems in order to provide a secure, repeatable alignment between a magazine and handle of a CEW.

Figure 4A:
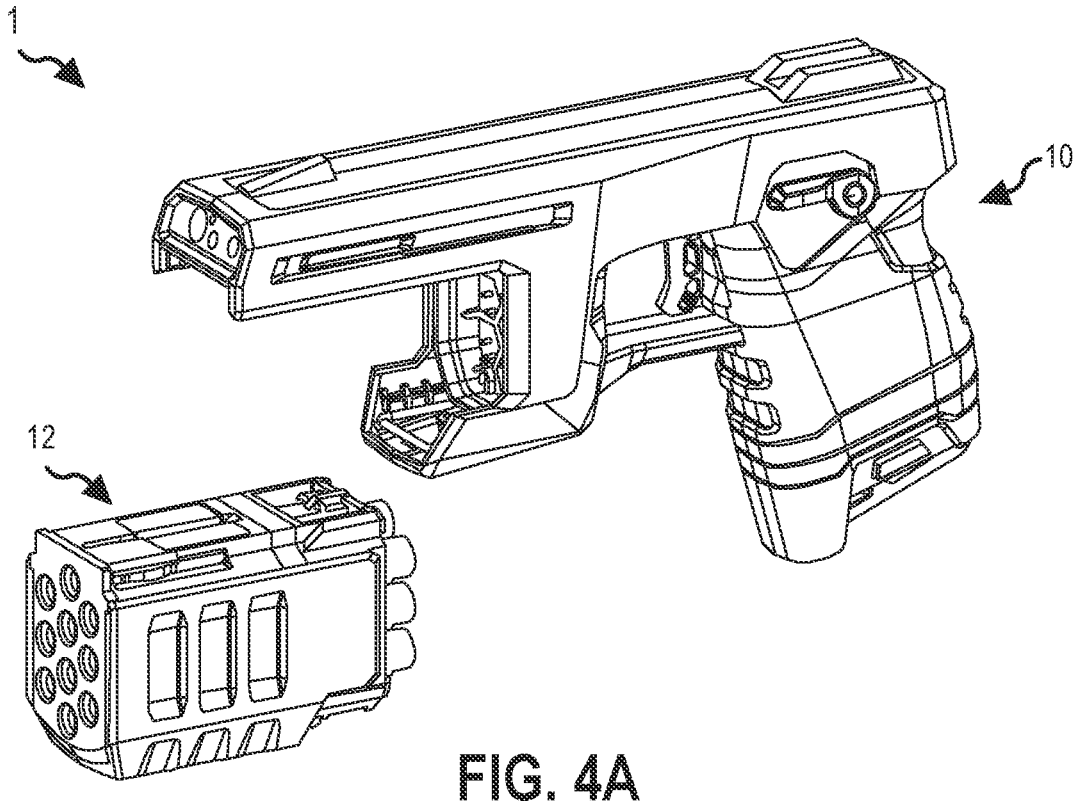
FIGS. 4A-4C are perspective views of a magazine being inserted into a CEW handle, in accordance with various embodiments.
Figure 4B:
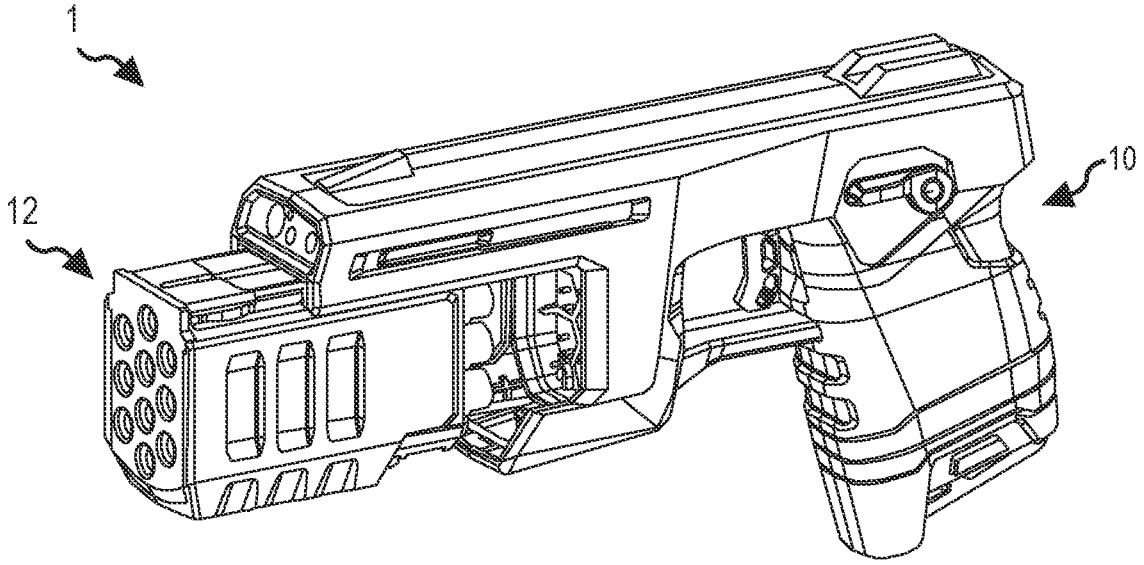
Figure 4C:
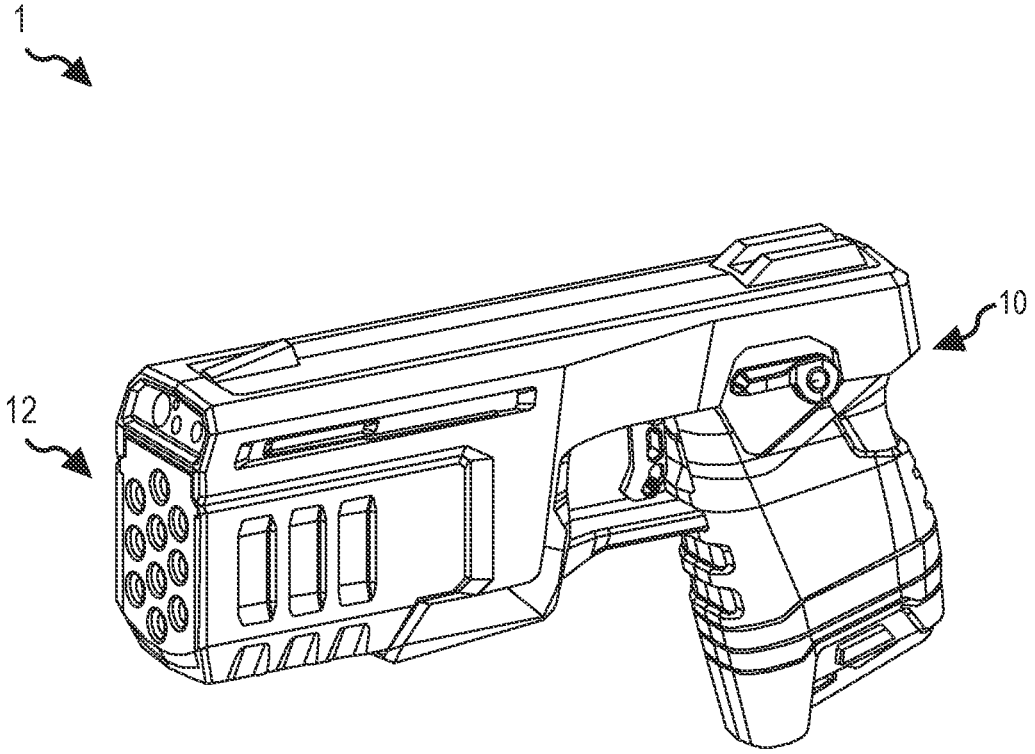

FIGS. 4A-4C are front perspective views of a magazine being inserted into a CEW, in accordance with various embodiments. FIG. 4A is a perspective view of a CEW 1 comprising a magazine 12 and a CEW handle 10, as described in conjunction with FIGS. 1, 3A-3B. Magazine 12 is not inserted and not locked in a bay of CEW handle 10 as shown in FIG. 4A. In various embodiments, a CEW 1 comprises one or more lock and release mechanisms configured to receive, align, and maintain a position of magazine 12 in a bay of the CEW handle 10 for deployment of cartridges from the magazine 12. In some embodiments, the lock and release mechanisms of the CEW handle 10 correspond to complementary mechanisms on the magazine 12, such that the mechanisms of the CEW handle 10 interact with the complementary mechanisms on the magazine 12 to receive, align, and maintain a position of the magazine 12 in the bay of the CEW handle 10. The CEW 1 may comprise one or more lock and release mechanisms, such that the lock and release mechanisms described herein may be used in combination or apart, and, further, may be used in combination with other lock and release mechanisms not described herein.

Additionally, lock and release mechanisms may be mechanical, electronic, or electrical in nature, such that, as described above, the magazine 12 may be mechanically, electronically, or electrically aligned and coupled within a bay of the CEW handle 10. In some embodiments wherein the CEW handle 10 and/or the magazine 12 comprise multiple lock and release mechanisms, the lock and release mechanisms may be a combination of mechanical, electronic, and/or electrical in nature.

FIG. 4B is a perspective view comprising a magazine 12 being inserted into a CEW handle 10. Magazine 12 is inserted, but not locked into the bay of CEW handle 10 as shown in FIG. 4B. When inserted, magazine 12 may be moved along the bay of CEW handle 10. One or more lock and release mechanisms of the magazine 12 interact with complementary lock and release mechanisms of the bay of the CEW handle 10 to align the magazine 12 to be inserted correctly into the CEW handle 10. For example, in some embodiments, one or more surfaces or mechanisms of the bay of the CEW handle 10 interact with complementary surfaces or mechanisms of the magazine 12 to align the magazine 12 within the bay. Examples of these one or more surfaces and mechanisms are described in further detail in FIGS. 5A-8, in accordance with various embodiments.

FIG. 4C is a perspective view comprising a magazine 12 inserted and locked into a bay of a CEW handle 10. Magazine 12 is fully inserted (e.g., fully coupled, engaged with, etc.) within a bay of CEW handle 10 as shown in FIG. 4C. In response to the respective lock and release mechanisms of the magazine 12 and the CEW handle 10 interacting to align the magazine 12 to the bay of the CEW handle 10, the magazine 12 is positioned correctly to be locked into the bay of the CEW handle 10. Responsive to the magazine 12 being locked into the bay of the CEW handle 10, an electrical connection is established between one or more cartridges of the magazine 12 and the bay of the CEW handle 10, such that a user of the CEW 1 may deploy the cartridges from the magazine 12. When locked into the bay of CEW handle 10, magazine 312 may be securely retain in the bay. Interaction of respective lock and release mechanisms of CEW handle 10 and magazine 12 may prevent separation of CEW 10 and magazine 12 when the magazine 12 is locked in the bay. The separation may be prevented unless a predetermined force is applied to at least one lock and release mechanism as further discussed below. In some embodiments, different mechanisms may be used to align the magazine 12 to be inserted into the bay of the CEW handle 10 and to lock the magazine 12 into position. In other embodiments, mechanisms may both align the magazine 12 to be inserted into the bay of the CEW handle 10 and lock the magazine 12 into place in the bay of the CEW handle 10. Example mechanisms are described in further detail in FIGS. 5A-8, in accordance with various embodiments.

Figure 5A:
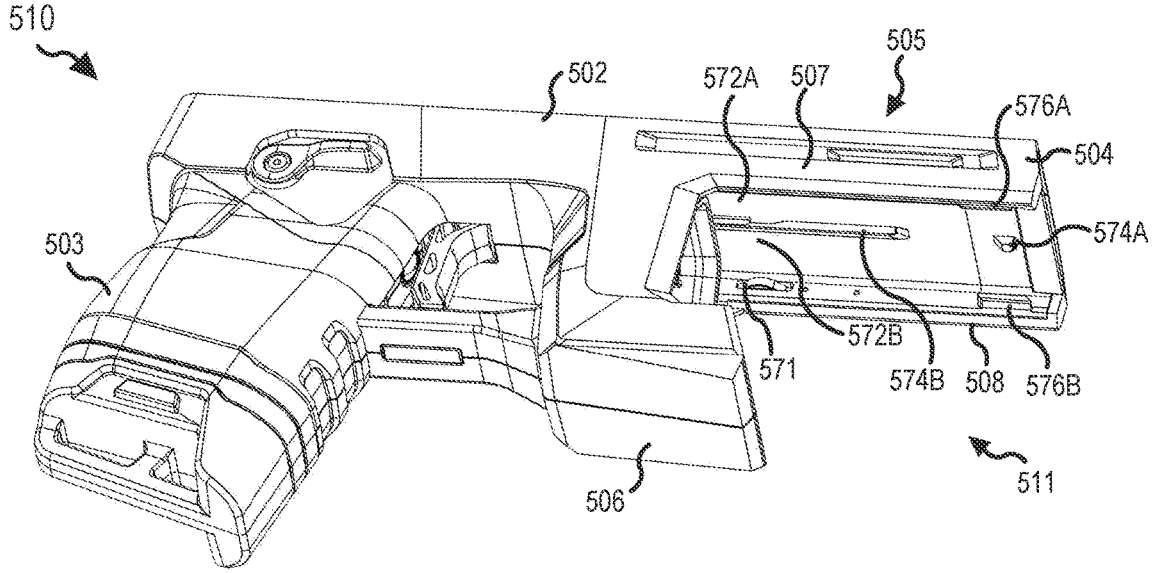
FIGS. 5A-5C are perspective views of a CEW handle, in accordance with various embodiments.
Figure 5B:
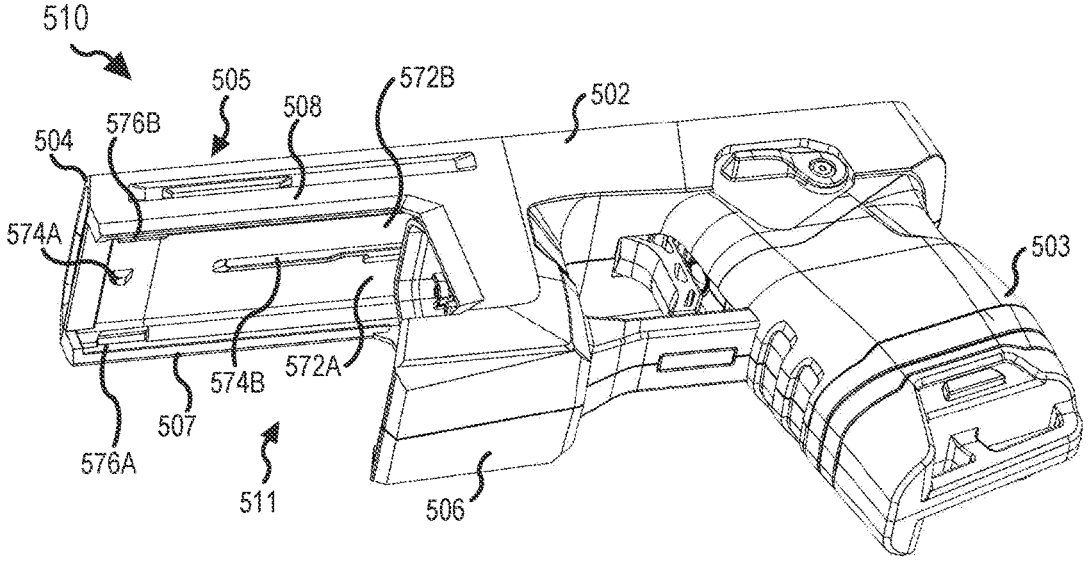
Figure 5C:
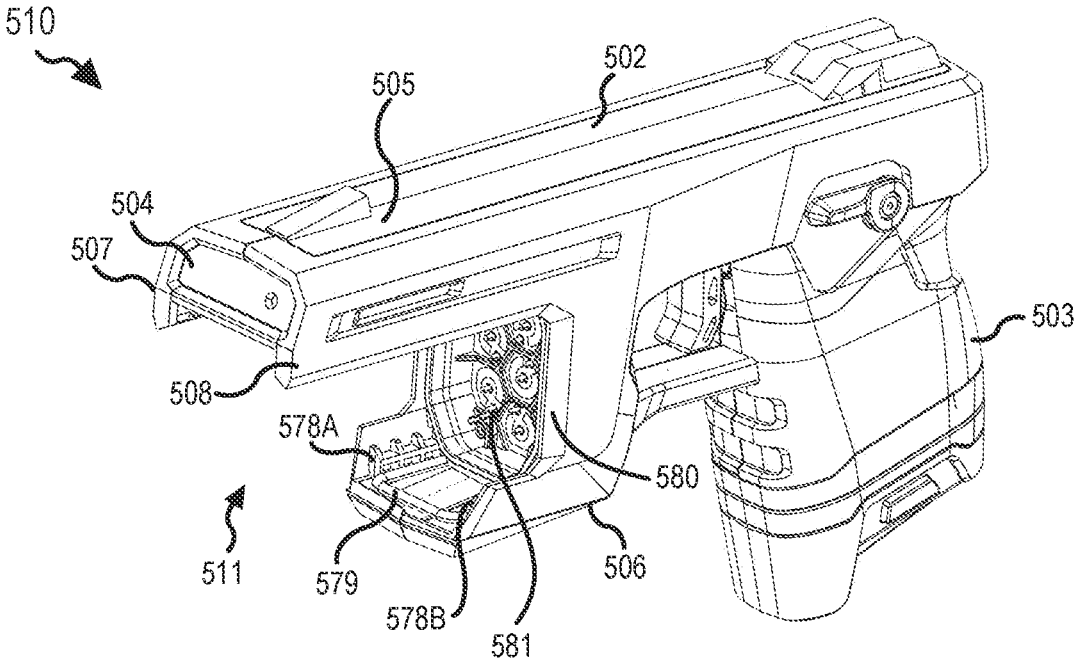

In various embodiments, and with reference to FIGS. 5A-5C, a CEW handle 510 is disclosed. CEW handle 510 may be similar to any other CEW handle, housing, or the like disclosed herein. CEW handle 510 may comprise one or more mechanical interfaces (e.g., lock and release mechanisms, datum, bias springs, handle mechanical interfaces, etc.) configured to engage a magazine in response to the magazine being inserted into a bay of CEW handle 510. For example, CEW handle 510 may comprise a first mechanical interface configured to engage a top surface of a magazine and a second mechanical interface configured to engage a bottom surface of a magazine. Each mechanical interface may comprise one or more separate interfaces, as discussed further herein.

In some embodiments, a mechanical interface may comprise one or more datums. As used herein, a "datum" refers to a surface used to align a first entity with a second entity. For example, a datum may be a surface configured to interact or interface with complementary surface on a second entity. A datum may interact or interface with other mechanisms, such as bias springs, ramps, grooves, protrusions, and the like. For example, a datum of CEW handle 510 may interface with a datum of a magazine to align the magazine to be inserted into the bay of CEW handle 510. A datum may provide additional purposes for aligning the first and second entities, e.g., being structural components of an entity, and may be defined by protruding or indented sections. A datum may comprise a fixed surface. The fixed surface may be integrally formed and/or positioned on a housing of device. A datum may comprise a reference surface. The reference surface may be disposed at a predetermined location on a first entity relative to another feature on the first entity. When a second entity interacts (i.e., engages, physically contacts, couples) with the datum, the other feature of the first entity may be aligned with another feature disposed on the second entity. For example, when a datum of CEW handle 510 and a datum of magazine 512 interact, an electrical contact of CEW handle 510 may be aligned with a bore in a magazine in which an electrical contact of a cartridge may be disposed in magazine.

In embodiments, a datum may enable alignment between a first entity comprising the datum and a second entity along an axis in which the second entity interacts with the datum. For example, the datum may enable alignment between the first entity and the second entity in a first direction in which the second entity engages the datum of the first entity. The first direction may comprise a direction toward the datum from the second entity. The datum may not enable alignment between the first entity and second entity along other axes. For example, the datum may not preclude movement and/or enable alignment in a second direction different from the first direction. In some embodiments, and in order to provide alignment between the first entity and second entity in multiple directions, multiple respective datum may be provided, wherein each datum enables alignment in a respective direction of the multiple directions.

In embodiments, a datum may comprise a planar surface. The planar surface may enable alignment with a second entity along an axis perpendicular to the planar surface. The planar surface may enable alignment toward the datum along the axis perpendicular to the planar surface. The planar surface may enable relative movement between the datum and the second entity in directions parallel to the planar surface.

CEW handle 510 may comprise a body 502 (e.g., a handle body, a housing, etc.) having a handle end 503 (e.g., a first end) opposite a loading end 504 (e.g., a second end, a deployment end, etc.). Body 502 may comprise a top surface 505 opposite a bottom surface 506. Body 502 may comprise a first side 507 (e.g., a right side) opposite a second side 508 (e.g., a left side). First side 507 and second side 508 may be disposed between top surface 505 and bottom surface 506. Body 502 may comprise a bay 511 defining an opening through loading end 504. Bay 511 may at least partially define an opening in loading end 504 through first side 507, second side 508, and/or bottom surface 506 (e.g., as depicted in FIGS. 5A-5C). In embodiments, a forward direction may be disposed along an axis from handle end 503 toward loading end 504 and an upward direction may be disposed along an axis from bottom surface 506 toward top surface 507. The forward direction may be opposite a direction in which magazine 512 is inserted into bay 511. A front of bay 511 may comprise a portion of bay 511 at loading end 504.

Bay 511 may define or comprise various mechanical interfaces configured to engage a magazine in response to the magazine being inserted into bay 511. In that regard, the mechanical interfaces may be located on an inner surface of bay 511. In the embodiment of FIGS. 5A-5C, the CEW handle 510 comprises a first set of mechanical interfaces (e.g., first mechanical interfaces, first handle mechanical interfaces, top surface mechanical interfaces, etc.) located proximate top surface 505. In the embodiment of FIGS. 5A-5C, the CEW handle 510 may alternately or additionally comprise a second set of mechanical interfaces (e.g., second mechanical interfaces, second handle mechanical interfaces, bottom surface mechanical interfaces, etc.) located proximate bottom surface 506. For example, the first set of mechanical interfaces may comprise one or more interfaces from a group comprising first set of datum 572, second set of datum 574, a third set of datum 576, and bias spring 571. Alternately or additionally, the second set of mechanical interfaces may comprise one or more interfaces from a group comprising fourth set of datum 578 and gasket 580. In various embodiments, the first set of mechanical interfaces may include three sets of datums and one bias spring. The second set of mechanical interfaces may include a set of datum and a retaining snap. In other embodiments, each set of mechanical interfaces of CEW handle 510 may comprise fewer or additional datums and/or bias springs, and the mechanisms may be arranged or positioned differently, or may align or engage magazine differently, than shown in conjunction with FIGS. 5A-5C.

In embodiments, the first and second sets of mechanical interfaces may align a magazine and CEW handle 510 in different directions. For example, the first set of mechanical interfaces may align a magazine to the CEW handle in lateral directions from first side 507 toward second side 508 and/or from second side 508 toward first side 507. The second set of mechanical interfaces may align the magazine in a rearward direction from loading end 504 toward a handle end 503. In alternate or additional embodiments, the first and second sets of mechanical interfaces may, in combination, align magazine 512 and CEW handle 510 in a same direction. For example, a mechanical interface of the second set of mechanical force may provide a resilient force that aligns the magazine in an upward direction relative to a mechanical interface of the first set of mechanical interfaces.

In various embodiments, bay 511 may define or comprise a first set of datum including a first datum 572A and a second datum 572B (collectively, first set of datum 572). The first set of datum 572 may define a flat upper surface of the bay 511. For example, first datum 572A may define a flat upper surface of bay 511 proximate first side 507 and second datum 572B may define a flat upper surface of bay 511 proximate second side 508. In some embodiments, first datum 572A and second datum 572B may be separated by a datum (e.g., datum 574B, as discussed further herein). In response to a magazine being inserted into the bay 511, the first set of datum 572 may align the magazine vertically to the bay 511 by providing a contact surface to the top of the magazine during alignment and insertion. In some embodiments, first datum 572A and/or second datum 572B is configured to interact with a corresponding datum of the magazine. In other embodiments, first datum 572A and/or second datum 572B may be configured to interact with a bias spring or other mechanism of the magazine.

In various embodiments, bay 511 may comprise a bias spring 571. The bias spring 571 is configured to interact with and maintain tension with a corresponding surface or datum of a magazine in response to the magazine being inserted into and/or coupled with bay 511. In some embodiments, the bias spring 571 is disposed within bay 511 proximate second side 508. In other embodiments, the bias spring 571 may be disposed within bay 511 proximate first side 507. In other embodiments, the CEW 1 may have corresponding bias springs disposed along each side of the bay 511 (e.g., both first side 507 and second side 508), each configured to interact with a respective surface or datum of a magazine in response to the magazine being inserted into and/or coupled within bay 511.

In various embodiments, bay 511 may define or comprise a second set of datum including a third datum 574A and a fourth datum 574B (collectively, second set of datum 574). The second set of datum 574 may be disposed proximate top surface 505 within bay 511. The second set of datum 574 may be disposed along top surface 505 within bay 511. For example, the second set of datum 574 may be disposed at a front of the bay 511 and at the rear of the bay 511, such that in response to a magazine being inserted into the bay 511, the second set of datum 574 aligns the magazine horizontally (e.g., laterally) within the bay. The second set of datum 574 may comprise a convex surface and a concave surface. The convex surface may be configured to interact with a complementary concave surface of a magazine and the concave surface may be configured to interact with a complementary convex surface of the magazine. The complementary interaction may prevent (or at least partially reduce) horizontal movement of the magazine within bay 511.

Third datum 574A may define a protrusion extending radially inward from proximate top surface 505 into bay 511. Third datum 574A may be centered between first side 507 and second side 508. In other embodiments, third datum 574A may be offset from center (e.g., closer to first side 507 or second side 508), or may comprise a pair of offset datum (e.g., a first datum closer to first side 507 and a second datum closer to second side 508). Third datum 574A may be configured to interface with a groove or concave surface of a magazine, as discussed further herein.

Fourth datum 574B may define a groove extending radially outward from bay 511 proximate top surface 505. Fourth datum 574B may be coaxial with third datum 574A. Fourth datum 574B may be configured to interface with a protrusion or convex surface of a magazine, as discussed further herein. In various embodiments, fourth datum 574B may define a groove having varied physical dimensions along a length of the groove (e.g., width, depth, etc.). For example, and as depicted in FIGS. 5A and 5B, fourth datum 574B may comprise a middle portion having a smaller width than at least one of a front end or a rear end of the groove. Varied physical dimensions along the length of the groove may at least partially aid in retaining a protrusion or convex surface of a magazine within the groove.

In embodiments, second set of datum 574 may be disposed adjacent to the first set of datum 572. For example, each datum of the second set of datum 574 may extend from or be recessed from the first set of datum 572. Each datum of the second set of datum 574 may be encircled by the first set of datum 572 or partially encircled by a datum of the first set of datum 572.

In embodiments, the second set of datum 574 may provide alignment in different direction relative to the first set of datum 572. The different direction may be a perpendicular direction relative to a direction in which the first set of datum provide alignment. For example, the first set of datum 572 may provide alignment in an upward direction and the second set of datum may provide alignment in a lateral direction. The alignment may be provided in different directions, despite each of the first set of datum 572 and second set of datum 574 being integrated with a same surface of bay 511 and/or a same side of bay 511. The same surface may comprise a top surface and the same side may comprise a top side of bay 511.

Bias spring 571 may be configured to provide a force (e.g., a side force, a left force, a right force, a lateral force, a horizontal force, etc.) against a magazine in response to the magazine being inserted within bay 511. For example, in response to bias spring 571 being disposed proximate second side 508, bias spring 571 may provide a force against the magazine to retain the magazine against first side 507 of bay 511. In some embodiments, the force may be provided parallel to one or more datum of the bay 507. For example, bias spring 571 may provide a force in a direction parallel to the first set of datum 572.

In embodiments, two or more mechanical interfaces of a set of mechanical interfaces may provide a compressive mechanical interface. The compressive mechanical interface may comprise at least one resilient mechanical force configured to apply a spring force to an entity in a first direction and at least one second mechanical interface configured to apply a contact force to the entity in a second direction opposite the first direction. In some embodiments, the second mechanical interface may comprise a non-resilient mechanical interface. For example, a compressive mechanical interface may comprise bias spring 571 and a portion of a side surface of each of third datum 574A and/or fourth datum 574B that is oriented in the direction of bias spring 571. In accordance with a spring force of bias spring 571, the compressive mechanical interface may provide a persistent force to persistently align a corresponding surface of a magazine opposite the portion of the side surface of third datum 574A and/or fourth datum 574B. This persistent force may constant and reproducibly provide this alignment, including when other forces temporarily applied relative to the magazine and CEW housing 510 in an opposite direction. In accordance with the resilient mechanical force applied via the compressive mechanical force, a same alignment between an inserted magazine and CEW housing 510 may be provide when the same magazine is repeatedly coupled to CEW housing 510 or different magazines are coupled to CEW housing 510 at different times.

In embodiments, set of mechanical interfaces may be disposed asymmetrically on CEW handle 510. For example, bias spring 571 may be disposed on a first side of CEW handle 510. CEW handle 510 may lack (i.e., not include, exclude, etc.,) a corresponding bias spring on a second side of CEW handle 510 opposite the first side. In accordance with the asymmetric set of mechanical interfaces, a force to align a magazine may be provided in a first lateral direction, but not a second lateral direction opposite the first lateral direction. For example, bias spring 571 may provide a resilient force (i.e., spring force) in a rightward direction, but the first set of mechanical interfaces may not provide another resilient force in a leftward direction. CEW handle 510 may lack another bias spring that might otherwise apply a resilient force on a side of a magazine opposite a side of the magazine to which bias spring 571 interacts. In embodiments, the asymmetrically applied force may ensure a largest force by which the magazine is aligned is provided in a single direction along a lateral axis. The asymmetrically applied force may avoid misalignment that might otherwise occur when similar strength biasing forces are commonly applied along both directions and/or on opposite sides of an entity such as a magazine.

In various embodiments, bay 511 may define or comprise a third set of datum including a fifth datum 576A and a sixth datum 576B (collectively, third set of datum 576). The third set of datum 576 may comprise a series of protruding surfaces disposed on each side of the bay 511. The third set of datum 576 may be disposed proximate the top and front of the bay 511 so as to interact with a corresponding mechanism of a magazine upon insertion of the magazine into the bay 511. In some embodiments, the third set of datum 576 are a top surface of protrusions disposed on each side of the bay 511, such that the third set of datum 576 aligns the magazine horizontally and vertically and guides the magazine to interact with the first set of datum 572 and/or the second set of datum 574.

For example, fifth datum 576A may be disposed proximate first surface 507 and sixth datum 576B may be disposed proximate second surface 508. Fifth datum 576A may comprise a protrusion extending outward from first surface 507 (e.g., towards second surface 508). Sixth datum 576B may comprise a protrusion extending outward from second surface 508 (e.g., towards first surface 507). Fifth datum 576A may be coplanar and/or coaxial with sixth datum 576B. Fifth datum 576A and/or sixth datum 576B may each be configured to interface with respective grooves or concave surfaces of a magazine, as discussed further herein.

In response to a magazine interacting correctly with each of the first set of datum 572, the second set of datum 574, and/or the third set of datum 576 during insertion of the magazine into bay 511, the magazine is aligned to be locked into the bay 511 such that a connection is established between the magazine and the CEW for deployment of cartridges of the magazine.

In various embodiments, bay 511 may comprise or define a fourth set of datum including a seventh datum 578A and an eighth datum 578B (collectively, fourth set of datum 578). The fourth set of datum 578 may comprise a series of protruding surfaces disposed proximate bottom surface 506. The fourth set of datum 578 may be disposed proximate the bottom and front of the bay 511 so as to interact with a corresponding mechanism of a magazine upon insertion of the magazine into the bay 511. In some embodiments, the fourth set of datum 578 are a bottom surface of protrusions disposed on each side of the bay 511, such that the fourth set of datum 578 aligns a bottom surface of the magazine horizontally and vertically and guides the magazine to interact with a retaining snap, as discussed further herein.

For example, seventh datum 578A may be disposed proximate first surface 507 on bottom surface 506, and eighth datum 578B may be disposed proximate second surface 508 on bottom surface 506. Seventh datum 578A may comprise a protrusion extending outward in a direction from first surface 507 and/or bottom surface 506 (e.g., towards second surface 508 and/or top surface 505). Seventh datum 578A may further extend from first surface 507 and/or bottom surface 506 toward an opening of bay 511. Eighth datum 578B may comprise a protrusion extending outward in a direction from second surface 508 and/or bottom surface 506 (e.g., towards first surface 507 and/or top surface 505) Eighth datum 578B may further extend from first surface 507 and/or bottom surface 506 toward an opening of bay 511. Seventh datum 578A may be coplanar and/or coaxial with eighth datum 578B. Seventh datum 578A and/or eighth datum 578B may each be configured to interface with a bottom surface of a magazine, as discussed further herein.

In various embodiments, bay 511 may comprise a retaining snap 579. Retaining snap 579 may be configured to engage or interface with a bottom surface of a magazine, in response to the magazine being inserted into bay 511. Retaining snap 579 may physically separate seventh datum 578A and eighth datum 578B on bottom surface 506. Retaining snap 579 may be coupled to an inner surface of bay 511. Retaining snap 579 may extend in a forward direction towards an opening of bay 511.

In embodiments, retaining snap 579 may comprise a resilient member. For example, retaining snap 579 may comprise a spring, wire-snap mechanism, bent or shaped wire, and/or the like. Retaining snap 579 may comprise any suitable size and/or shape, such as, for example, a square shape, a rectangular shape, a circular shape, a C-shape, and/or the like. Retaining snap 579 may be coupled at a first end proximate first side 507 and at a second end proximate second side 508. For example, retaining snap 579 extends from a first side of bay 511 (proximate bottom surface 506) and connects to an opposite side of bay 511. A portion of retaining snap 579 intermediate the first end and second end of retaining snap may move (e.g., bend, flex, etc.) relative to the first and second ends. The portion of retaining snap 579 intermediate the first end and the second end may engage a bottom surface of a magazine. In other embodiments, retaining snap 579 may be another mechanical component extending from bay 511 and configured to engage a bottom surface of a magazine.

In various embodiments, retaining snap 579 may be configured to apply an upward force (e.g., a force towards top surface 505) on a magazine inserted within bay 511. The upward force may at least partially aid in retaining the magazine within bay 511. The upward force may bias the magazine against one or more datum of the first set of datum 572. CEW housing 510 may comprise a second compressive mechanical interface that includes retaining snap 579 and the one or more datum of the first set of datum 572.

In various embodiments, retaining snap 579 may alternately or additionally be configured to apply an inward force (e.g., towards handle end 503) on a magazine inserted within bay 511. The inward force may at least partially aid in retaining the magazine within bay 511. The inward force may bias the magazine in a rearward direction. A CEW comprising CEW housing 510 may otherwise lack a mechanical interface configured to provide a resilient force in a direction opposite the rearward direction, thereby retaining a magazine against an interposer 581 or other component at a closed end of bay 511.

In various embodiments, bay 511 may comprise a gasket 580. Gasket 580 may couple to or interact with a magazine in response to a magazine being inserted into the bay. In response to the magazine being removed from the bay, the gasket 580 may decouple from the magazine and remain positioned in the bay 511.

In various embodiments, the gasket 580 comprises a body having a first end opposite a second end. First end may comprise an outer edge configured to receive a magazine.

Second end may comprise an open end configured to interact with one or more other components of the bay 511, e.g., an interposer 581. Interposer 581 may comprise one or more electrical contacts by which CEW handle 510 provides one or more electrical signals to cartridges disposed in a magazine when the magazine is received in bay 511. In some embodiments, gasket 580 may comprise an end surface (e.g., a flat surface, platform, etc.) of one or more other components of the bay 511, e.g., such that gasket 580 is an end surface of an interposer 581. Gasket 580 may be sized and shaped to receive a magazine and seal against an outer edge of the magazine. For example, and with reference to FIG. 3B, second end 352 of magazine 312 may comprise an open end exposing one or more ends of cartridges 355 loaded into magazine 312. Gasket 580 may couple to (e.g., interface with, engage, etc.) second end of magazine 312 such that one or more ends of cartridges 355 are no longer exposed and/or such that one or more ends of cartridges 355 are guided to interact with other components of bay 511. Gasket 580 may comprise a flexible material. Gasket 580 may comprise an inner circumference that is equal or less than an outer circumference of second end 352 of magazine 312 such that gasket 580 forms a seal around the second end 352 when magazine 312 is received in bay 511 and gasket 580.

In various embodiments, gasket 580 may be configured to apply an upward force (e.g., a force towards top surface 505) and/or an outward force (e.g., away from handle end 503) on a magazine inserted within bay 511. The upward force and/or outward force may at least partially aid in retaining the magazine within bay 511.

In various embodiments, and with reference to FIGS. 6A-6F, a magazine 612 for a CEW is disclosed. Magazine 612 may be similar to any other magazine or the like disclosed herein. Magazine 612 may comprise one or more mechanical interfaces (e.g., lock and release mechanisms, datum, bias springs, magazine mechanical interfaces, etc.) configured to engage a CEW handle in response to magazine 612 being inserted into a bay of the CEW handle. For example, magazine 612 may comprise a first set of mechanical interfaces configured to engage a top inner surface of a CEW handle. The top inner surface may comprise a surface on at least a first side of the bay along which one or more datum of a first set of datum of a CEW handle are provided. Alternately or additionally, magazine 612 may comprise a second set of mechanical interfaces configured to engage a bottom inner surface of the CEW handle. Each set of mechanical interface of magazine 612 may comprise one or more separate mechanical interfaces, as discussed further herein. The first set of mechanical interfaces of magazine 612 may comprise one or more mechanical interface from a first set of datum, 658, a second set of datum 664, a third set of datum 666, bias spring 661. The second set of mechanical interfaces of magazine 612 may comprise one or more mechanical interface from a fourth set of datum and a release actuator. The fourth set of datum may comprise one or more ramps. The release actuator may further comprise translatable grip 660.

Each mechanical interface may comprise one or more datum, bias springs, ramps, or the like. The datum, bias springs, ramps, or the like may be configured to interact with corresponding mechanisms of a CEW handle, as described in conjunction with FIGS. 5A-5C. In the illustrated embodiments, magazine 612 comprises three sets of datum, one bias spring, and two sets of ramps. In other embodiments, the magazine 612 may comprise fewer or additional sets of datum, bias springs, ramps, or the like, and the mechanisms may be arranged or positioned differently than shown and described herein.

In various embodiments, magazine 612 may comprise a body 650 (e.g., magazine body, magazine housing, etc.) having a first end 651 opposite a second end 652. Body 650 may comprise a top surface 658 opposite a bottom surface 659. Body 650 may define one or more bores 653. A bore 653 may comprise an axial opening through housing 650, defined and open on first end 651 and/or second end 652. Each bore 653 may be configured to receive a cartridge 355. Each bore 653 may be sized and shaped accordingly to receive and house cartridge 355 prior to and during deployment of cartridge 355 from magazine 612. Each bore 653 may comprise any suitable deployment angle. One or more bores 653 may comprise similar deployment angles. One or more bores 653 may comprise different deployment angles. Body 650 may comprise any suitable or desired number of bores 653, such as, for example, two bores, five bores, nine bores, ten bores (e.g., as depicted), and/or the like.

In various embodiments, magazine 612 may comprise a release actuator configured to selectively release magazine 612 from a bay of a CEW handle. A release actuator may be mechanically actuated between a first position and a second position. Magazine 612 may be released from the bay upon the release actuator being disposed into the second position from the first position. Magazine 612 may be prevented from being uncoupled from the bay when the release actuator is disposed in the first position. While the release actuator is disposed in the first position, magazine 612 may become locked in the bay upon the magazine being inserted into the bay. In embodiments, the release actuator may comprise one or more buttons, switches, or sliding elements. In some embodiments, the release actuator may comprise non-electrical components.

In embodiments, a release actuator may be coupled to another element of magazine 612 such that, responsive to movement of the release actuator, movement of the other element also occurs. In some embodiments, the release actuator may be fixedly coupled to the other element. An extent of movement of the release actuator may cause a same extent of motion of the other element. For example, a degree and direction of motion of the release actuator may cause a same degree and direction of motion for the other element. In other embodiments, the release actuator may be variably coupled to the other element such that a degree and direction of motion of the release actuator may cause an amplified, reduced, and/or opposite degree and/or direction of motion for the other element. In embodiments, release actuator may be translationally and/or rotationally coupled to the other element.

Figure 6A:
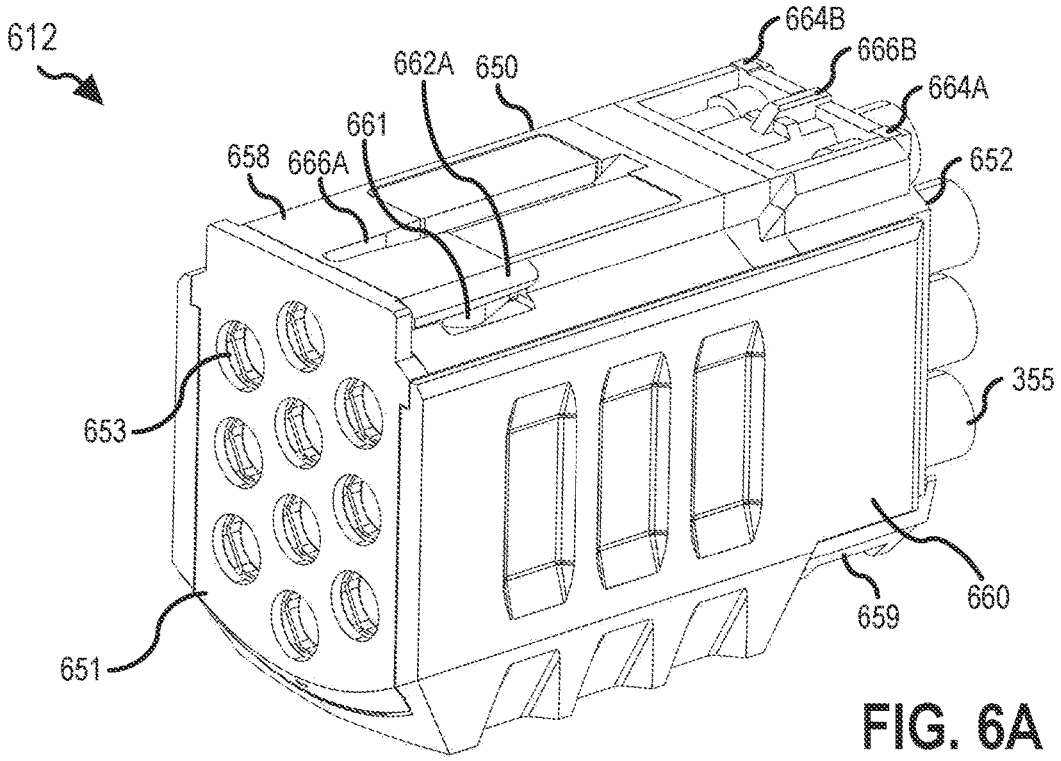
FIGS. 6A-6F are perspective views of a magazine for a CEW, in accordance with various embodiments.
Figure 6B:
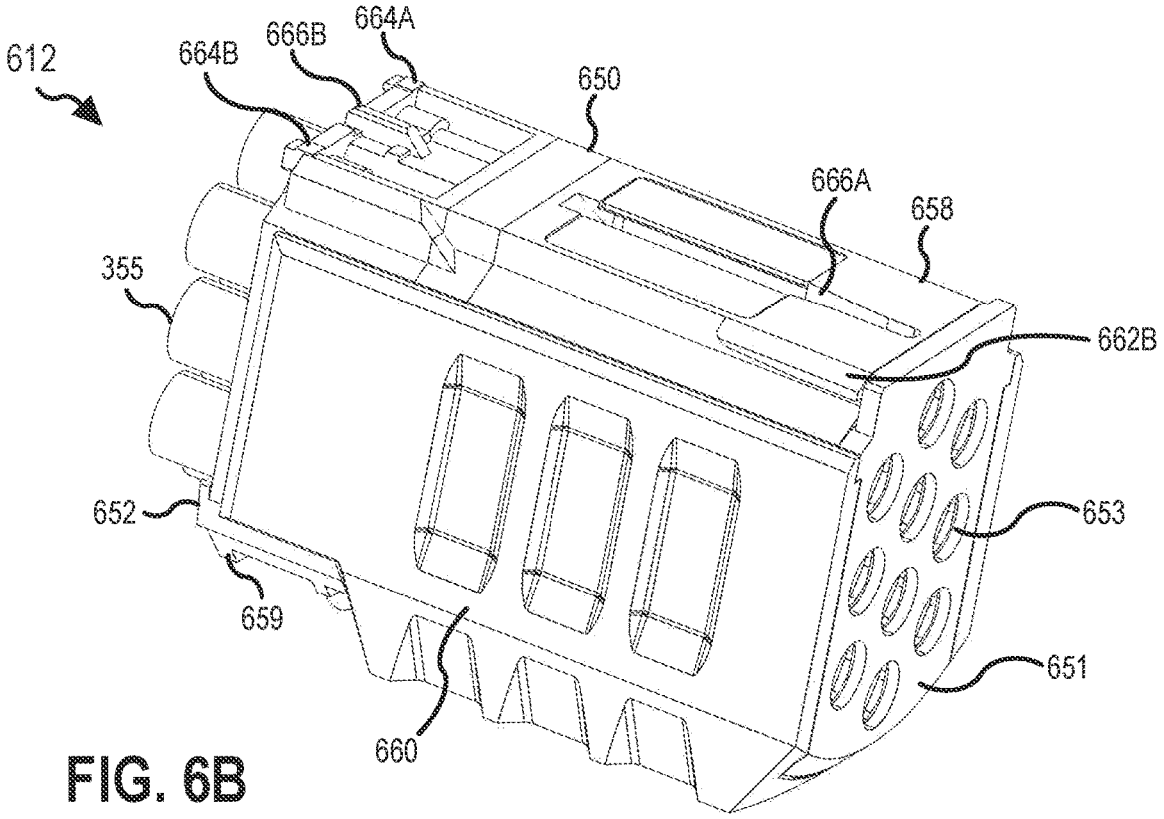
Figure 6C:
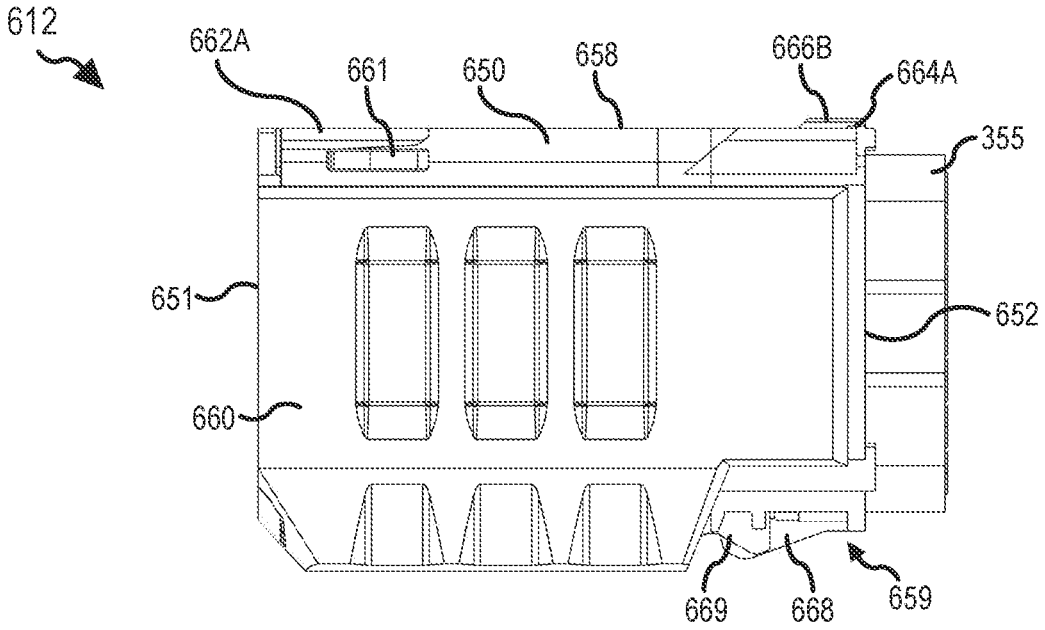
Figure 6D:
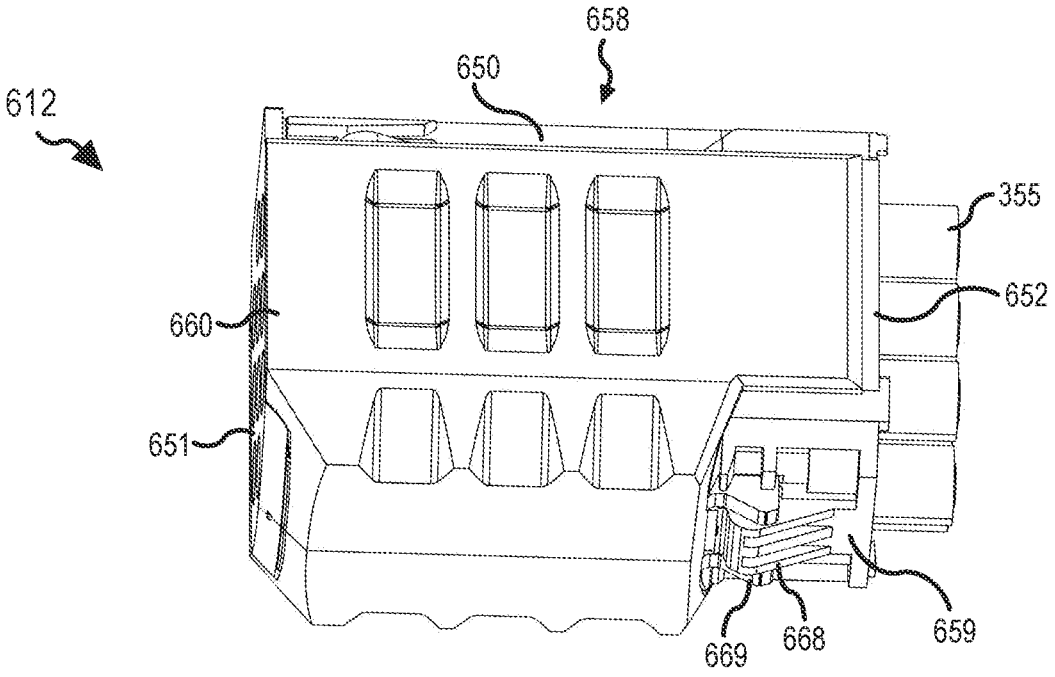
Figure 6E:
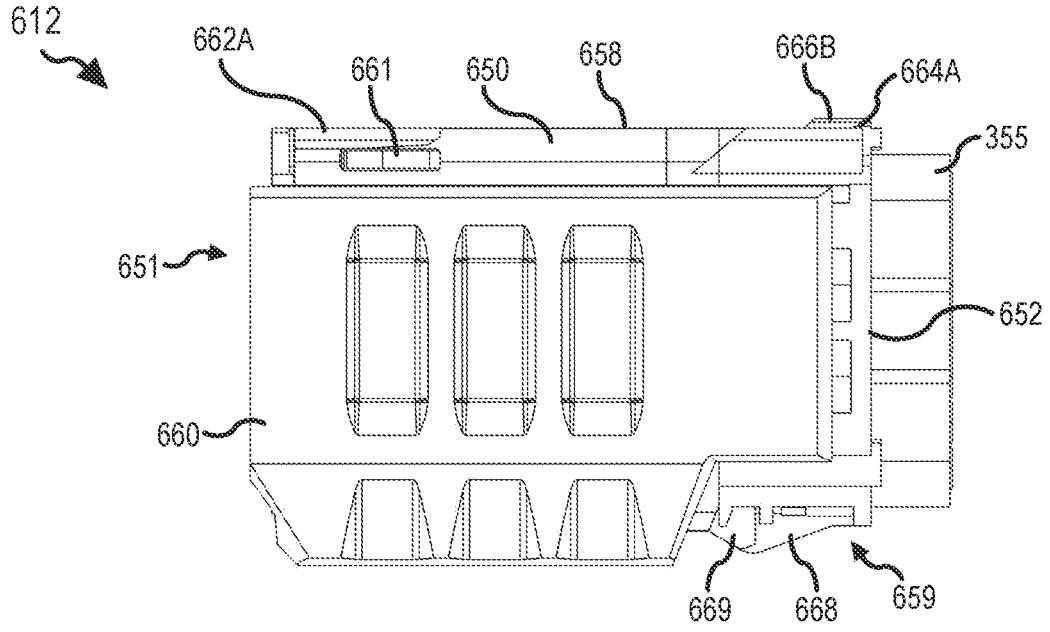
Figure 6F:
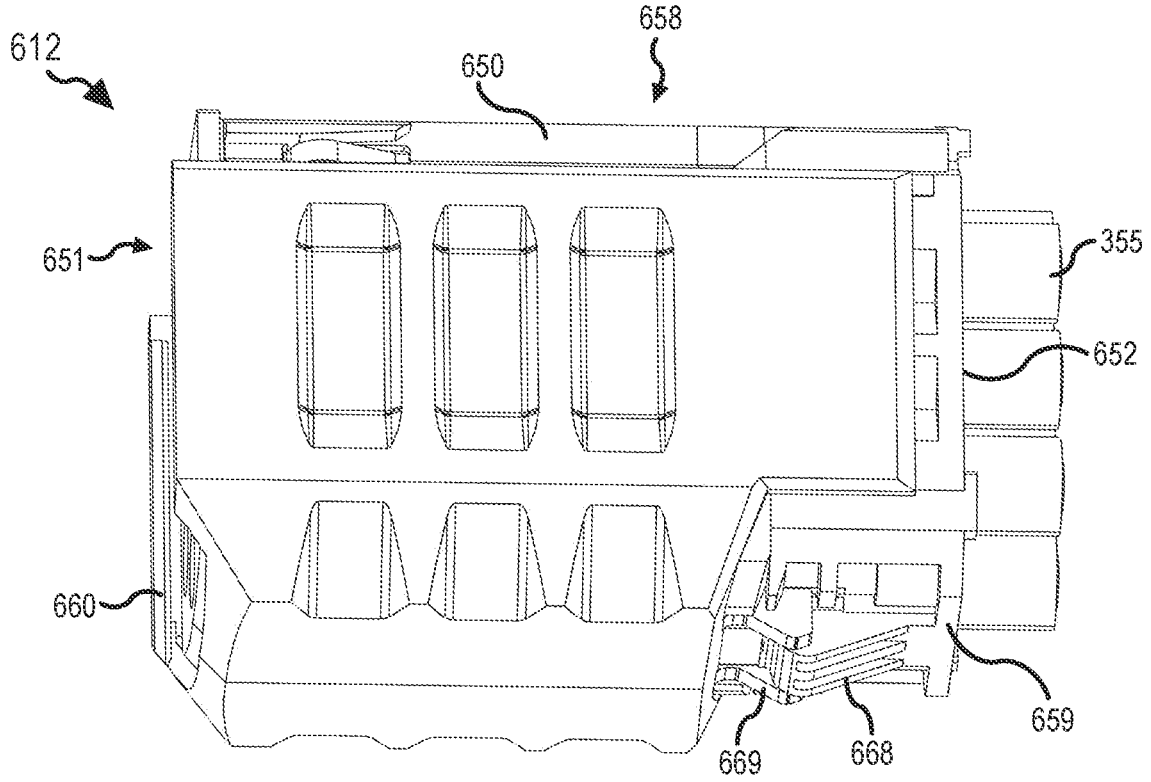

In various embodiments, a release actuator of magazine 612 may comprise a translatable grip 660. Translatable grip may comprise a slide configured to move relative to another portion of magazine 612. Translatable grip 660 may be coupled to body 650. Translatable grip 660 may at least partially cover (e.g., obstruct) a left side, a right side, and bottom surface 659 of body 650. Translatable grip 660 may be configured to operate from a first position (e.g., as depicted in FIGS. 6C and 6D) to a second position (e.g., as depicted in FIGS. 6E and 6F). In the first position, translatable grip 660 may enable magazine 612 to engage and couple within a bay of a CEW handle, as discussed further herein (e.g., a locked position). In the second position, translatable grip 660 may enable magazine 612 to disengage and decouple from the bay of the CEW handle, as discussed further herein (e.g., a release position). Translatable grip 660 may translate in a substantial forward (e.g., towards or past first end 651) to rearward direction (e.g., towards or past second end 652), or rearward to forward direction, to operate between the first position and the second position. Translatable grip 660 may translate in a same direction in which magazine 612 may be inserted into a bay of a CEW handle. Translatable grip 660 may translate in a same direction in which magazine 612 may be released from a bay of a CEW handle.

In embodiments, one or more portions of a release actuator may be disposed about a periphery of a magazine. For example, the release actuator may be disposed on a single side of the magazine. In other embodiments, the release actuator may be disposed on opposite and/or multiple sides of the periphery of a magazine. For example, translatable grip 660 may be disposed along a left side, a right side, and bottom surface 659 of body 650.

A release actuator may comprise a surface detail configured to improve surface friction between the actuator and a portion of a user by which the actuator is actuated. For example, translatable grip 660 may comprise a series of grooves, grips, protrusions, surface coatings, materials, or the like configured to enable a user to operate translatable grip 660 from the first position to the second position.

Body 650 may comprise a series of grooves, springs, and/or the like configured to couple or engage with translatable grip 660 (e.g., protrusions of translatable grip 660) to enable translatable grip 660 to operate from the first position to the second position. Body 650 may comprise one or more springs configured to cause translatable grip 660 to return to the first position (e.g., without user operation), in response to being operated into the second position. The one or more springs may be disposed within magazine 612 relative to translatable grip 660. In that regard, the one or more springs may be coupled to body 650 and an inner surface of translatable grip 660. The one or more springs may bias the inner surface, and thus the translatable grip 660, in a direction toward the first position of the translatable grip 660 relative to body 650. Translatable grip 660 may automatically return to the first position when a mechanical force that disposes the translatable grip 660 in the second position is not received.

In various embodiments, body 650 may define or comprise a first set of datum including a first datum 662A and a second datum 662B (collectively, first set of datum 662). The first set of datum 662 may be disposed proximate each side of body 650. The first set of datum 662 may be disposed proximate first end 651. For example, first datum 662A may be disposed proximate a front first side of body 650, and second datum 662B may be disposed proximate a front second side of body 650. First datum 662A and second datum 662B may each comprise a protruding tab extending laterally from top surface 658.

The first set of datum 662 may be configured to interact with surfaces or datum of a CEW handle in response to magazine 612 being inserted within a bay of the CEW handle. For example, and with brief reference to FIGS. 5A-5C, first set of datum 662 may be configured to interact with third set of datum 576 upon insertion of magazine 612 into bay 511. Interaction between the first set of datum 662 of the magazine 612 and the third set of datum 576 of the CEW handle 510 align the magazine 612 horizontally and vertically and guides the magazine 612 into the bay 511 of the CEW handle 510. In the embodiment of FIGS. 6A-6B, the first set of datum 662 are protruding tabs and interaction with the third set of datum 576 of the bay 511 of the CEW 510 occurs along an underside of the protruding tabs of the first set of datum 662. In other embodiments, the first set of datum 662 may be shaped or positioned differently, and interaction may occur along a different surface or point.

In various embodiments, a bias spring 661 may be disposed along a side of the magazine 612. The bias spring 661 may be configured to interact and maintain tension with an interior surface of a bay of a CEW handle, such that the magazine 612 is pushed towards an opposite interior surface of the bay of the CEW handle (e.g., bias spring 661 provides a force against as interior surface of the bay (e.g., a side force, a left force, a right force, a lateral force, a horizontal force, etc.)). In some embodiments, for example, the bias spring 661 is disposed on a left side of the body 650 and interacts with an interior surface of the bay of the CEW handle. The interaction between the bias spring 661 and the interior surface of the bay of the CEW handle pushes the magazine 612 to the right.

In some embodiments, the bias spring 661 is disposed along a side of the magazine 612 proximate first datum 662A. For example, bias spring 661 may be coupled to an outer surface of body 650 in a location under first datum 662A. In other embodiments, the bias spring 661 is disposed along a side of the magazine 612 proximate second datum 662B. For example, bias spring 661 may be coupled to an outer surface of body 650 in a location under second datum 662B. In other embodiments, magazine 612 may have corresponding bias springs disposed along each side of body 650, each bias spring configured to interact with a respective surface of a bay of a CEW handle. For example, bias spring 661 may interact with a side surface of bay 511 on which bias spring 571 is disposed with brief reference to FIG. 5A-B. When magazine 612 is received in bay 511, each of bias spring 571 and bias spring 661 may be disposed on a same side of magazine 612 between magazine 612 and CEW handle 510. Accordingly, each of a bias spring 571 and bias spring 661 may provide a respective resilient force to magazine 612 in a lateral direction toward the same portion of the side surface of each of third datum 574A and/or fourth datum 574B. A CEW comprising magazine 612 and CEW handle 510 may include a third compressive mechanical interface that includes bias spring 661 and the portion of the side surface of each of third datum 574A and/or fourth datum 574B.

In various embodiments, body 650 may define or comprise a second set of datum including a third datum 664A and a fourth datum 664B (collectively, second set of datum 664). The second set of datum 664 may be disposed along top surface 658 proximate second end 652. For example, third datum 664A may be disposed proximate a rear first side of body 650 (e.g., opposite first datum 662A), and fourth datum 664B may be disposed proximate a rear second side of body 650 (e.g., opposite second datum 662B). The second set of datum 664 may each comprise smooth surfaces and/or protruding tabs.

The second set of datum 664 may be configured to interact with surfaces or datum of a CEW handle in response to magazine 612 being inserted within a bay of the CEW handle. For example, and with brief reference to FIGS. 5A-5C, second set of datum 664 may be configured to interact with a first set of datum 572 of the bay 511 of the CEW handle 510 to vertically align the magazine 612 within the bay 511 upon insertion of magazine 612 into bay 511. In the embodiment of FIGS. 6A-6B, the second set of datum 664 are protruding tabs and interaction with the first set of datum 572 of the bay 511 of the CEW handle 510 occurs along a top surface of the second set of datum 664. In other embodiments, the second set of datum 664 may be shaped or positioned differently, and interaction may occur along a different surface or point.

In various embodiments, body 650 may define or comprise a third set of datum including a fifth datum 666A and a sixth datum 666B (collectively, third set of datum 666). The third set of datum 666 may be disposed proximate top surface 658. For example, the third set of datum 666 may be disposed at a front location on top surface 658 and at a rear location of top surface 658, such that in response to magazine 612 being inserted into a bay of a CEW handle, the third set of datum 666 aligns the magazine 612 horizontally within the bay. The third set of datum 666 may comprise a convex surface and a concave surface. The convex surface may be configured to interact with a complementary concave surface of a bay of a CEW handle and the concave surface may be configured to interact with a complementary convex surface of the bay of the CEW handle. The complementary interaction may prevent (or at least partially reduce) horizontal movement of magazine 612 within the bay of the CEW handle.

Fifth datum 666A may define a groove extending inward from top surface 658. Fifth datum 666A may be coaxial with sixth datum 666B. Fifth datum 666A may be configured to interface with a protrusion or convex surface of a bay of a CEW handle, as discussed further herein. In various embodiments, fifth datum 666A may define a groove having varied physical dimensions along a length of the groove (e.g., width, depth, etc.). For example, and as depicted in FIGS. 6A and 6B, fifth datum 666A may comprise a first portion proximate first end 651 having a smaller width than a second remaining portion of fifth datum 666A. Varied physical dimensions along the length of the groove may at least partially aid in retaining a protrusion or convex surface of bay of a CEW handle within the groove. The varied physical dimensions may be different than the physical dimensions of another groove of a CEW, such that a set of mechanical interfaces comprising the grooves or datum may comprise two or more grooves with different shapes. For example, a CEW comprising CEW handle 510 and magazine 612 may comprise fourth datum 574B having a first shape and fifth datum 66A comprising a second shape different from the first shape. In accordance with the different shapes, different alignment forces may be provided by the datum upon insertion of the magazine in a bay of the CEW handle.

Sixth datum 666B may define a protrusion extending outward from top surface 658. Sixth datum 666B may be centered between a first side and a second side of body 650. In other embodiments, sixth datum 666B may be offset from center (e.g., closer to a first side or a second side), or may comprise a pair of offset datum (e.g., a first datum closer to a first side and a second datum closer to a second side). Sixth datum 666B may be configured to interface with a groove or concave surface of a bay of a CEW handle, as discussed further herein. In embodiments, sixth datum 666B may comprise a first surface on a first side of the protrusion. The first surface may comprise a planar surface. The planar surface may be configured to interact with a corresponding surface of another datum of a CEW handle. In some embodiments, sixth datum 66B may comprise a second surface on a second side opposite the first side that has a different shape than the first surface. The surface may be non-planar and/or asymmetrical. The first surface may be configured to interact with a portion of a side surface of fourth datum 574B. The second surface may reinforce sixth datum 666B on the second side to prevent mechanical failure of sixth datum 666B when sixth datum interacts with fourth datum 574.

In some embodiments, the third set of datum 666 comprises a protruding tab at a rear of the magazine 612 and an indented or concave surface at the front of the magazine 612. In other embodiments, the third set of datum 666 may be shaped or positioned differently, e.g., with two protruding tabs positioned at a rear and a front position of the magazine 612. With brief reference to FIGS. 5A-5C, the third set of datum 666 of the magazine 612 interact with a second set of datum 574 of the bay 511 of the CEW handle 510 to horizontally align the magazine 612 within the bay 511 during insertion of the magazine 612 into the bay 511. For example, fifth datum 666A of magazine 612 may interface with third datum 574A of bay 511, and sixth datum 666B of magazine 612 may interface with fourth datum 574B of bay 511.

In various embodiments, magazine 612 may comprise or define a fourth set of datum. The fourth set of datum may comprise a set of ramps. The set of ramps may comprise a plurality of ramps. The plurality of ramps may include a locking ramp 668. Locking ramp 668 may comprise a stationary ramp. The plurality of ramps may include a release ramp 669. Release ramp 669 may comprise a translatable ramp. Locking ramp 668 and release ramp 669 may be disposed proximate bottom surface 659. Locking ramp 668 and release ramp 669 may each comprise one or more ramps, protrusions, or the like extending outward from bottom surface 659. Locking ramp 668 and/or release ramp 669 may be configured to interface or engage with one or more mechanical interfaces of a bottom surface of a bay of a CEW handle, as discussed further herein.

In various embodiments, locking ramp 668 may be coupled to bottom surface 659 of body 650 proximate second end 652. Locking ramp 668 may comprise a triangular or approximately triangular structure comprising a leading edge (e.g., an edge or surface positioned towards second end 652) and a trailing edge (e.g., an edge or surface positioned towards first end 651). When magazine 612 is coupled to a CEW handle, the leading edge may be received in a bay of the CEW handle prior to the training edge. The leading edge and the trailing edge of locking ramp 668 may comprise different grades (e.g., magnitudes of slope). For example, the trailing edge of locking ramp 668 may comprise a steeper grade compared to the leading edge of locking ramp 668. Trailing edge may comprise a steep grade. For example, the steep grade may define an angle greater than forty-five degrees along the trailing edge and a surface adjacent the trailing edge. Leading edge may comprise a shallow grade. A steep grade may be steeper than a shallow grade. For example, the shallow grade may define an angle less than forty-five degrees along the leading edge and a surface adjacent the leading edge.

In various embodiments, a set of datum may comprise an adjustable set of datum. For example, fourth set of datum may comprise an adjustable set of datum. The adjustable set of datum may comprise at least one datum that may be selectively moved (e.g., translated, rotated, slid, etc.) responsive to actuation of a release actuator. When the release actuator is disposed in a first position of the release actuator, the adjustable set of datum may be disposed in a corresponding first position. When the release actuator is disposed in a second position of the release actuator, the adjustable set of datum may be disposed in a corresponding second position different from the first position of the fourth set of datum. Movement of the release actuator between the first and second positions of the release actuator may cause the adjustable set of datum to move between the first and second positions of the set of adjustable datum. For example, release ramp 669 may be coupled to a release actuator. The release actuator may be configured to selectively move release ramp 669 relative to body 650 of magazine 612. The release ramp may be integrated with the release actuator such that relative movement of the release actuator causes corresponding relative movement of the release actuator. For example, release ramp 669 may be coupled to a bottom portion of translatable grip 660 proximate locking ramp 668. Release ramp 669 may comprise a triangular or approximately triangular structure comprising a leading edge (e.g., an edge or surface positioned towards second end 652) and a trailing edge (e.g., an edge or surface positioned towards first end 651). In embodiments, release ramp 669 may comprise a trailing edge 669 that defines an angle between trailing edge 669 and an adjacent surface of magazine 612, independent of a shape or presence of a leading edge. In embodiments, release ramp 668 may comprise a triangular portion of a mechanical interface comprising a trailing edge. The leading edge and the trailing edge of release ramp 669 may comprise different grades (e.g., magnitudes of slope). For example, the leading edge of release ramp 669 may comprise a steeper grade compared to the trailing edge of release ramp 669. In some embodiments, one or more sets of datum may comprise an adjustable datum, in addition to, or as an alternative to fourth set of datum of magazine. In other embodiments, one or more other sets of datum may comprise fixed, non-adjustable datum. In accordance with various embodiments, each datum aside from the fourth set of datum of magazine 612 may respectively comprise fixed, non-adjustable datum In various embodiments, the trailing edge of locking ramp 668 may comprise a steeper grade compared to the trailing edge of release ramp 669.

In various embodiments, release ramp 669 may be configured to operate from a first position to a second position (i.e., first and second position of release ramp 669 and/or fourth set of datum). Release ramp 669 may move between the first position and the second position. Release ramp 669 may move in response to actuation of a release actuator. For example, release ramp 669 may move in response to translatable grip 660 being operated from a first position of the translatable grip 660 to the second position translatable grip 660. Release ramp 669 may change positions in accordance with movement of translatable grip 660.

For example, with specific reference to FIGS. 6C and 6D, release ramp 669 is depicted in the first position. The first position may comprise a locked position. In the first position, the trailing edge of locking ramp 668 is closer to first end 651 than the trailing edge of release ramp 669. In the first position, and in accordance with some embodiments, a front edge of translatable grip 660 may be at least partially aligned with first end 651.

With specific reference to FIGS. 6E and 6F, release ramp 669 is depicted in the second position (e.g., a release position). In the second position, the trailing edge of release ramp 669 is closer to first end 651 than the trailing edge of locking ramp 668. In the second position, and in accordance with some embodiments, a front edge of translatable grip 660 may be at least partially forward first end 651.

In various embodiments, with brief reference against to FIGS. 5A-5C and continued reference to FIGS. 6A-6F, locking ramp 668 and release ramp 669 may be configured to interface with retaining snap 579 in response to magazine 612 being inserted into bay 511.

For example, magazine 612 may be inserted into bay 511 while translatable grip 660 and release ramp 669 are in their respective first positions (e.g., as depicted in FIGS. 6C and 6D). A forward edge of retaining snap 579 may contact the leading edge of locking ramp 668 and slide over the leading edge. Movement of retaining snap 579 relative to locking ramp 668 may further dispose retaining snap 579 between the trailing edge of locking ramp 668 and a bottom portion of translatable grip 660. Retaining snap 579 may be retained in position by the steeper grade of the trailing edge of locking ramp 668. Retaining snap 579 may apply an inward force against the trailing edge of locking ramp 668. Retaining snap 579 may apply an upward force against bottom surface 659 and/or release ramp 669. Retaining snap 579 may slide over the leading edge of locking ramp 668 yet resist sliding over the trailing edge of locking ramp 668 in accordance with a respective difference in grades between the leading edge and trailing edge relative to a common plane.

In operation, to remove magazine 612 from bay 511 a user may operate translatable grip 660 into the second position of translatable grip 660 (e.g., as depicted in FIGS. 6E and 6F). Responsive to the grip being operated, release ramp 669 may be disposed in the second position of release ramp 669. In the second position, retaining snap 579 may abut against the trailing edge of release ramp 669, and may no longer contact the trailing edge of locking ramp 668. In accordance with the second position of a release actuator, a trailing edge of the release ramp 669 may be selectively disposed intermediate retention snap 569 and locking ramp 668. Actuation of the release actuator may cause the release ramp 669 to move from a first position of the release ramp 669 to a second position of the release ramp 669. The shallower grade of the trailing edge of release ramp 669 (relative to the steeper grade of the trailing edge of locking ramp 668) may enable retaining snap 579 to release away from release ramp 669 and no longer apply an inward force against either of locking ramp 668 or release ramp 669. As retaining snap 579 is no longer applying the inward force, magazine 612 is released and able to be removed from bay 511.

In embodiments, a mechanical force applied to magazine 612 may decouple magazine 612 from a bay of a CEW handle when a release actuator is actuated. In embodiments, the release actuator may be actuated in a same direction in which a magazine may be released (i.e., remove, disengaged, decoupled from, etc.) from a bay of a CEW handle. Such an arrangement may enable a same mechanical force to both actuate the release actuator and remove a magazine, thereby simplifying an overall force required to decouple a magazine from a bay. For example, a force applied to translatable grip 660 toward first end 651 of magazine will both actuate translatable grip 660 and enable magazine 612 to be removed from a bay of a CEW handle. A force in this same direction, when not applied to the release actuator or insufficient to actuate the release actuator, may not decouple the magazine from the bay.

In response to the user no longer operating translatable grip 660, translatable grip 660 and release ramp 669 may return to the first position.

Figure 7A:
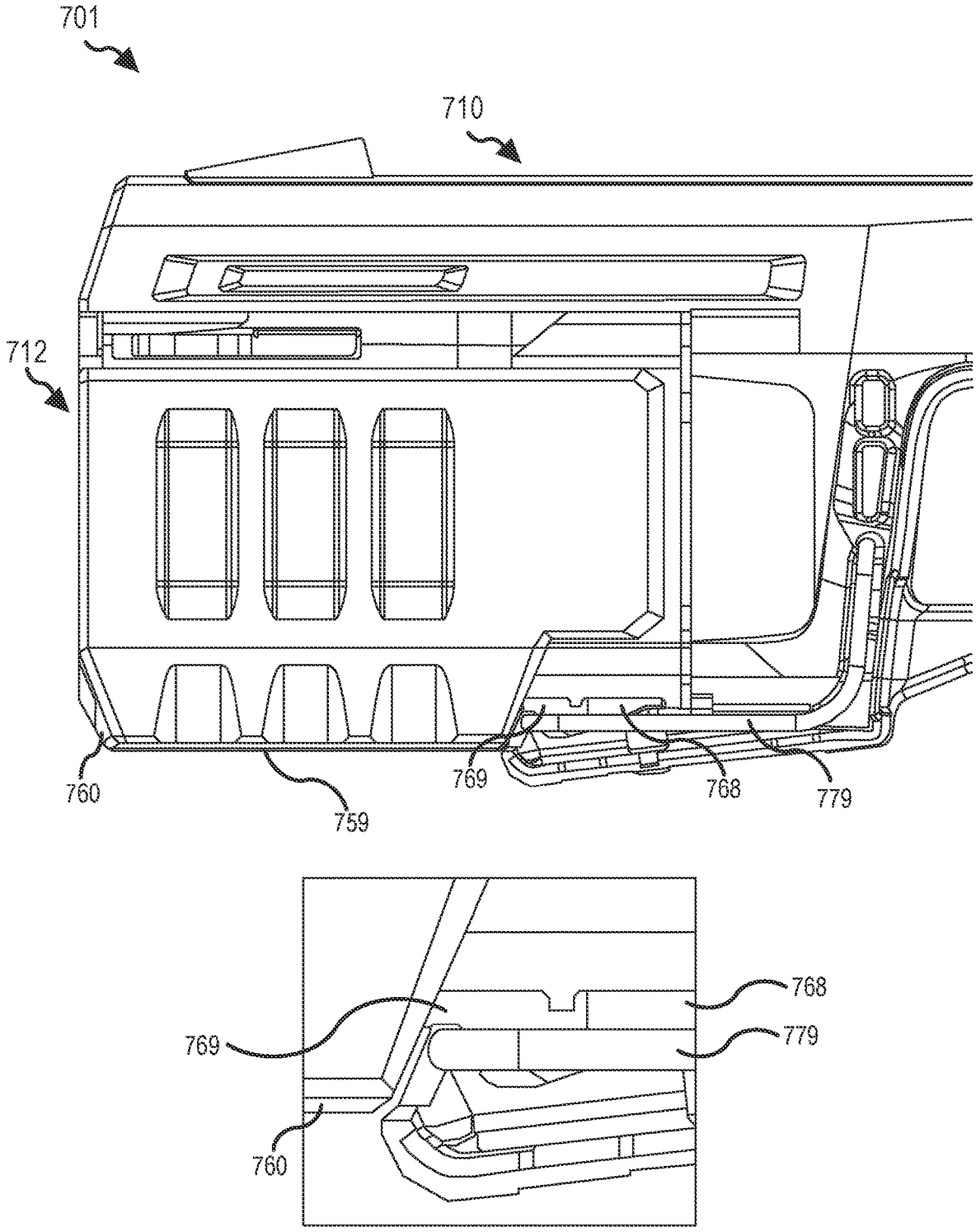
FIGS. 7A-7B are side perspective views of a magazine loaded into a CEW handle, in accordance with various embodiments.
Figure 7B:
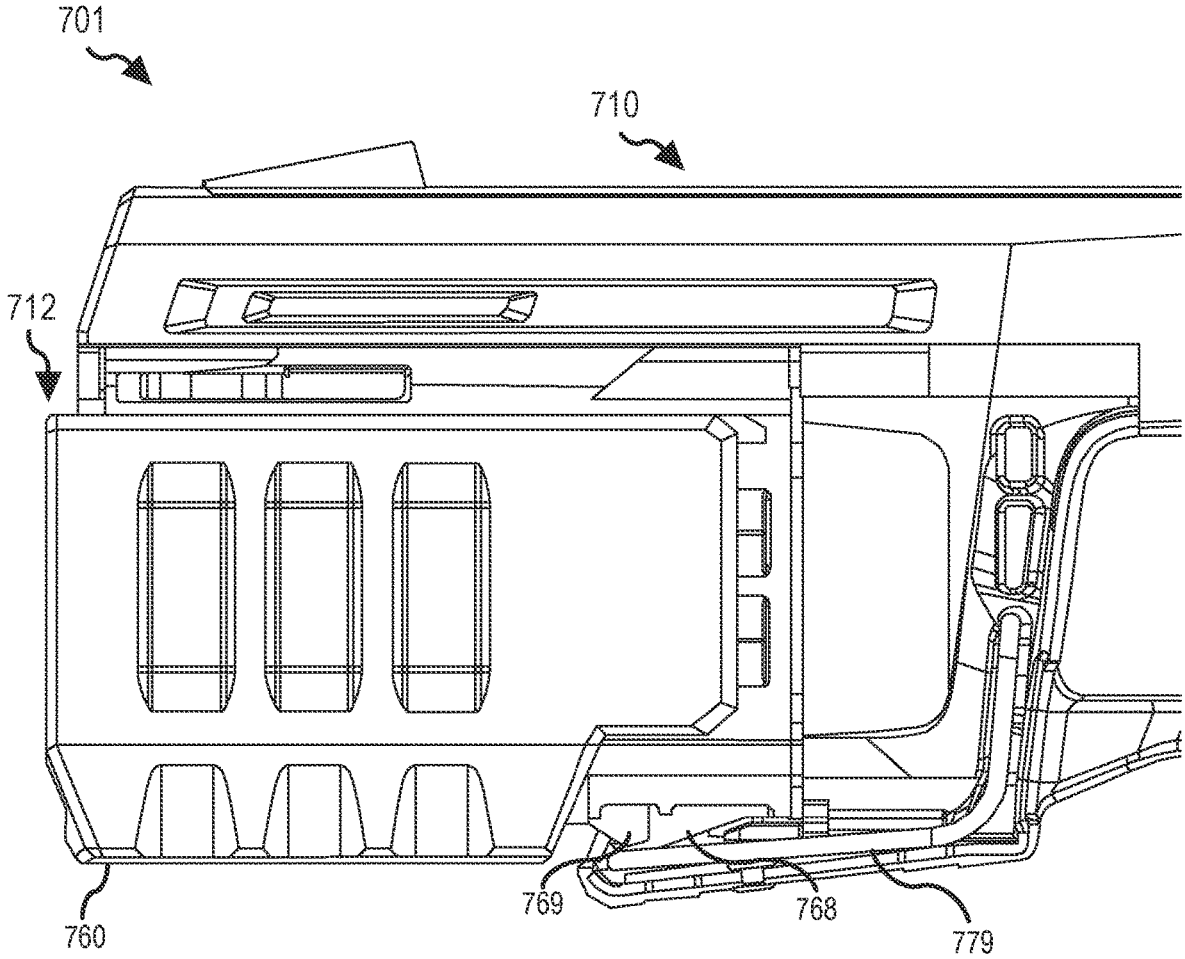
Figure 7B:
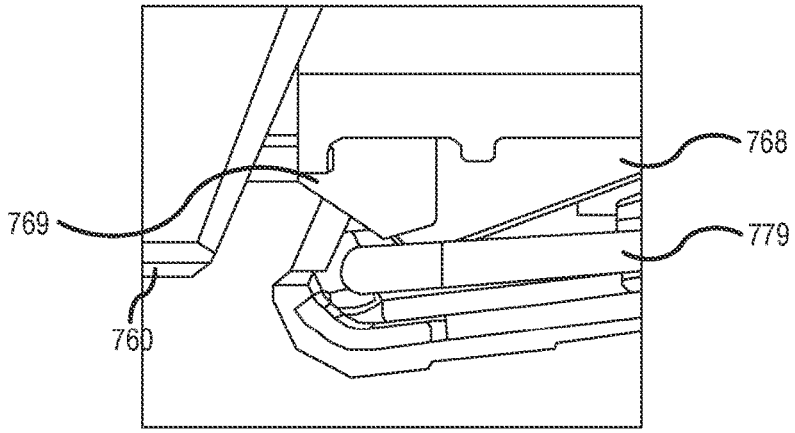

In various embodiments, and with reference to FIGS. 7A-7B, a CEW 701 having a CEW handle 710 and a magazine 712 is disclosed. CEW 701 may be similar to any other CEW disclosed herein. CEW handle 710 may be similar to any other CEW handle disclosed herein. Magazine 712 may be similar to any other magazine or other unit configured to house a deployable projectile or the like disclosed herein.

In some embodiments, FIG. 7A illustrates magazine 712 coupled to a bay of the CEW handle 710 and FIG. 7B illustrates the magazine 712 uncoupled from the bay of the CEW handle 710. For purposes of illustration, each of FIG. 7A comprise an overview (upper portion) and an expanded view (lower, square portion) of common components of CEW 701 either coupled together (FIG. 7A) or uncoupled (FIG. 7B). CEW handle 710 may comprise a retaining snap 779 configured to engage a bottom surface of magazine 712. For purposes of illustration, FIG. 7A-B further comprise partial cutaway views in which a portion of a housing of CEW 710 proximate retaining snap 779 is cutaway in order to depict relative positions of retaining snap 779, locking ramp 768, and release ramp 769. Retaining snap 779 may be disposed within a bottom surface of a bay of the CEW handle 710. Retaining snap 779 may be similar to any other retaining snap disclosed herein. Magazine 712 may comprise a locking ramp 768 and a release ramp 769. Locking ramp 768 may be similar to any other locking ramp disclosed herein. Locking ramp 768 may be coupled to a bottom surface of magazine 712. Release ramp 769 may be similar to any other release ramp disclosed herein. Release ramp 769 may be coupled to translatable grip 760 such that movement of translatable grip 760 causes movement of release ramp 769. Magazine 712 may comprise a release actuator. In some embodiments, the release actuator may comprise a translatable grip 760. Translatable grip 760 may be similar to any other translatable grip disclosed herein.

With specific reference to FIG. 7A, translatable grip 760 and release ramp 769 are depicted in a first position. The first position may comprise a first position of translatable grip 760 and a first position of release ramp 769. In the first position, a forward edge of retaining snap 779 may contact the leading edge of locking ramp 768, slide over the leading edge, be positioned between the trailing edge of locking ramp 768 and a bottom portion of translatable grip 760. Retaining snap 779 may be retained in position by the steeper grade of the trailing edge of locking ramp 768. Retaining snap 779 may apply an inward force against the trailing edge of locking ramp 768. The inward force may be applied toward a grip end of CEW 701 from retaining snap 779. Retaining snap 779 may apply an upward force against bottom surface 759 and/or release ramp 769. The inward force may be applied toward a top surface of CEW handle 710 of CEW 701 from retaining snap 779. When locked in place, retaining snap 779 may additionally or instead be in contact with one or more other portions of the bay of the CEW handle 710.

With specific reference to FIG. 7B, translatable grip 760 and release ramp 769 are depicted in a second position. The second position may comprise a second position of translatable grip 760 and a second position of release ramp 769. In operation, to remove magazine 712 from a bay of CEW handle 710 a user may operate translatable grip 760 into the second position. In the second position, retaining snap 779 may abut against the trailing edge of release ramp 769, and may no longer contact the trailing edge of locking ramp 768. The shallower grade of the trailing edge of release ramp 769 (relative to the steeper grade of the trailing edge of locking ramp 768) may enable retaining snap 779 to release away from release ramp 769 and no longer apply an inward force against either of locking ramp 768 or release ramp 769. As retaining snap 779 is no longer applying the inward force, magazine 712 is released and able to be removed from bay 711.

In other embodiments, responsive to a user of the CEW 701 applying sufficient force and torque to overcome the release ramp 769 and/or the locking ramp 768, the retaining snap 779 is released from the release ramp 769 and/or the locking ramp 768 and may be uncoupled from the bay of the CEW handle 710. In other embodiments, the magazine 712 may be uncoupled from the bay of the CEW handle 710 responsive to a release mechanism (e.g., a button, lever, or other mechanical component of the CEW or the magazine) being operated by the user of the CEW. For example, the magazine 712 may be uncoupled from the bay of the CEW handle 710 responsive to a mechanical component supplying the force and torque required to overcome the release ramp 769 and/or the locking ramp 768, causing the retaining snap 779 to be released and the magazine 712 to be uncoupled.

Figure 8:
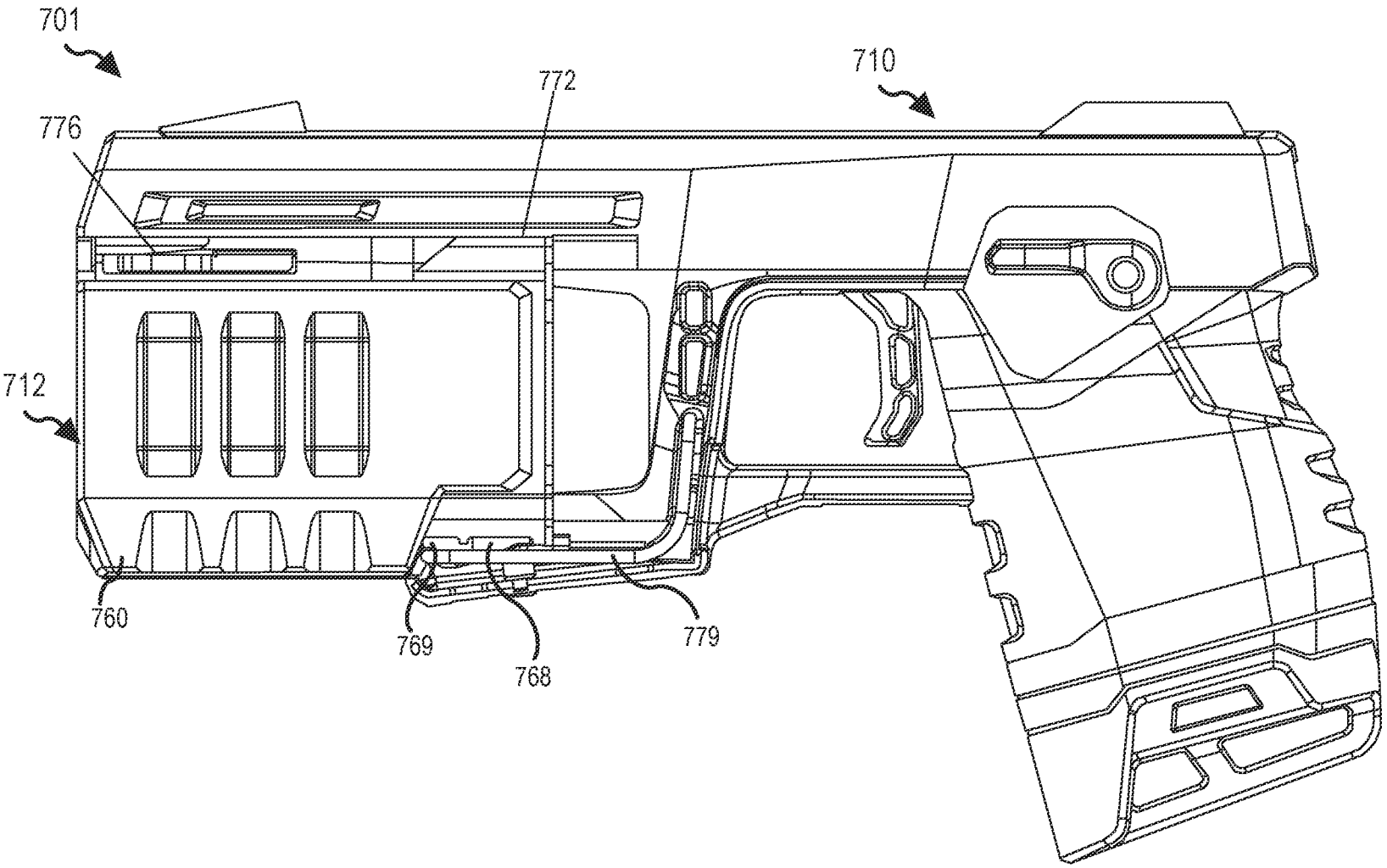
FIG. 8 is a side perspective view of a magazine coupled with a CEW handle, in accordance with various embodiments.

FIG. 8 is a side perspective view of a magazine 712 coupled with a CEW handle 710 using datum, bias spring, and ramp mechanisms, in accordance with various embodiments. Responsive to being coupled with a bay of a CEW handle 710, a magazine 712 interacts with the CEW handle 710 at a plurality of points (e.g., locations) to ensure that the magazine 712 is securely coupled to the CEW handle 710. A retaining snap 779 interacts with a locking ramp 768 and a release ramp 769 at a first location, applying pressure towards a top and rear of the magazine 712. The pressure of the retaining snap 779 towards the top and rear of the magazine 712 locks a rear face of the magazine 712 against a surface of the bay of the CEW handle 710 and a top surface of the magazine 712 against a first set of datum 772 of the bay of the CEW handle 710. At a second location, a gasket (not shown) positioned between the magazine 712. At a third and/or fourth locations, the handle of the CEW 710 applies an upward force and/or an outward force to the magazine. The interactions at the second, third, and/or fourth locations provide a moment to the magazine. In the side perspective view shown in FIG. 8, the moment acts counterclockwise on the magazine 712 The moment causes a top surface of the magazine 712 to interact with the third set of datum 776 of the bay of the CEW.

In the embodiment of FIG. 8, a combination of the interactions described above correctly align and lock the magazine 712 into the bay of the CEW handle 710 such that cartridges from the magazine 712 may be deployed by a user of the CEW. In other embodiments, the magazine 712 and the CEW handle 710 may comprise additional mechanisms and interactions for aligning and locking the magazine 712 not described herein.

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Examples of various exemplary embodiments embodying aspects of the invention are presented in the following example set. It will be appreciated that all the examples contained in this disclosure are given by way of explanation, and not of limitation.

What is claimed is:

1. A conducted electrical weapon ("CEW") comprising:

a handle comprising a bay for receiving a magazine, wherein the bay comprises a first set of datum and a first bias spring, the first set of datum comprising respective portions of a surface on at least a first side of the bay configured to align the magazine to be coupled to the bay and the first bias spring configured to maintain tension against a corresponding surface of the magazine; and the magazine comprising a second set of datum configured to interact with the first set of datum to align the magazine to be coupled with the bay, wherein the first set of datum is disposed along a top handle surface of the bay, and wherein the second set of datum is disposed along a top magazine surface of the magazine.

2. The CEW of claim 1, wherein the magazine further comprises a second bias spring, the second bias spring configured to maintain tension against an interior surface of the bay, wherein the tension causes the second set of datum of the magazine to interact with the first set of datum of the bay.

3. The CEW of claim 2, wherein each of the first bias spring and the second bias spring are disposed between the corresponding surface of the magazine and the interior surface of the bay when the magazine is coupled with the bay.

4. The CEW of claim 2, wherein the second bias spring interacts with the interior surface of the bay in a lateral direction perpendicular to a direction in which the magazine is inserted into the bay.

5. The CEW of claim 1, wherein the first set of datum is disposed along first opposing sides of the bay, and wherein the second set of datum is disposed along second opposing sides of the magazine.

6. The CEW of claim 1, wherein one or more of the first set of datum or the second set of datum comprises one or more protrusions.

7. The CEW of claim 1, wherein one or more of the first set of datum or the second set of datum comprises one or more grooves.

8. The CEW of claim 1, wherein one or more of the first set of datum or the second set of datum comprises one or more planar surfaces.

9. A handle for a conducted electrical weapon ("CEW") comprising:

a bay defining an opening configured to receive a magazine;

a first mechanical interface disposed in a top surface of the bay, wherein the first mechanical interface is configured to align the magazine for insertion within the bay; and a second mechanical interface disposed in a bottom surface of the bay, wherein the second mechanical interface is configured to provide at least one of an upward force or an inward force against a bottom surface of the magazine.

10. The handle of claim 9, wherein the first mechanical interface comprises at least two of one or more grooves, one or more protrusions, one or more engagement surfaces, or a bias spring.

11. The handle of claim 9, wherein the first mechanical interface comprises at least one of a convex surface or a concave surface.

12. The handle of claim 9, wherein the first mechanical interface comprises at least one of a first set of datum, a second set of datum, a third set of datum, or a bias spring.

13. The handle of claim 12, wherein the first mechanical interface comprises the first set of datum, wherein the first set of datum comprises a first datum defining a first contact surface of the bay proximate a first side of the bay and a second datum defining a second contact surface of the bay proximate a second side of the bay.

14. The handle of claim 13, wherein the first mechanical interface further comprises a bias spring and wherein the bias spring is coupled to the second side of the bay proximate the second datum.

15. The handle of claim 12, wherein the first mechanical interface comprises the second set of datum, wherein the second set of datum comprises a third datum defining a protrusion proximate the opening of the bay and a fourth datum defining a groove in the top surface of the bay.

16. The handle of claim 15, wherein the third datum is coaxial with the fourth datum.

17. The handle of claim 15 wherein the third datum is forward the fourth datum.

18. The handle of claim 12, wherein the first mechanical interface comprises the third set of datum, wherein the third set of datum comprises a fifth datum extending from a first side of the bay proximate the opening of the bay and a sixth datum extending from a second side of the bay proximate the opening of the bay.

19. The CEW of claim 1, wherein:

the top handle surface of the bay comprises a planar, top inner surface of the bay;

the first set of datum comprises a groove encircled by the planar, top inner surface of the bay;

the second set of datum comprises a protrusion that interacts with the groove; and the handle applies an asymmetrical force to the magazine via the first bias spring, wherein the asymmetrical force causes a surface of the groove to interact with a corresponding surface of the protrusion in a lateral direction parallel to the planar, top inner surface of the bay.

20. The CEW of claim 1, wherein the bay comprises a third set of datum comprising additional respective portions of an additional surface on at least a second side of the bay configured to align the magazine to be coupled to the bay, the second side of the bay opposite the first side of the bay.

* * * * *